US010487529B2

(12) United States Patent
Tollefson et al.

(10) Patent No.: US 10,487,529 B2
(45) Date of Patent: Nov. 26, 2019

(54) COLUMBARIUM

(71) Applicant: Eickhof Columbaria, Inc., Crookston, MN (US)

(72) Inventors: Peter Tollefson, Crookston, MN (US); Thomas DeBoer, Crookston, MN (US)

(73) Assignee: Eickhof Columbaria, Inc., Crookston, MN (US)

( * ) Notice: Subject to any disclaimer, the term of this patent is extended or adjusted under 35 U.S.C. 154(b) by 0 days.

(21) Appl. No.: 15/853,483

(22) Filed: Dec. 22, 2017

(65) Prior Publication Data

US 2018/0179778 A1 Jun. 28, 2018

Related U.S. Application Data

(60) Provisional application No. 62/438,846, filed on Dec. 23, 2016.

(51) Int. Cl.
*E04F 13/00* (2006.01)
*E04H 13/00* (2006.01)

(52) U.S. Cl.
CPC ..... *E04H 13/006* (2013.01); *E04H 13/003* (2013.01)

(58) Field of Classification Search
CPC ... E04H 13/001; E04H 13/006; E04H 13/003; E04H 13/008
USPC ..... 52/134–137
See application file for complete search history.

(56) References Cited

U.S. PATENT DOCUMENTS 750,157 A * 1/1904 Bonus ..... E04H 13/006 52/134
1,008,421 A * 11/1911 MacKay ..... E04H 13/006 52/133
1,174,867 A * 3/1916 Jenkins ..... E04H 13/00 52/130
1,183,323 A * 5/1916 Sievert ..... E04H 13/006 52/129
1,453,375 A * 5/1923 Allen ..... E04H 13/006 52/134
1,592,991 A * 7/1926 Sanders ..... E04H 13/005 52/130

(Continued)

FOREIGN PATENT DOCUMENTS

GB 1512758 A 6/1978
WO WO 2014020201 A1 2/2014

OTHER PUBLICATIONS

Reflection of Peace, Roselawn Cemetery, http://www.roselawncemetery.com/reflection-of-peace; website, Oct. 27, 2017, 4 pages.

*Primary Examiner* — Paola Agudelo
*Assistant Examiner* — Adam G Barlow
(74) *Attorney, Agent, or Firm* — Merchant & Gould P.C.

(57) ABSTRACT

A columbarium includes a concrete base and defines an inner core surrounded by niches mounted around the periphery of the inner core. An inner wall separates the niches from an open volume in the inner core. A lightweight core includes at least three spaced apart steel posts attached to the inner wall and the base and supports a capstone covering the open core and the plurality of niches. Base trim elements are adjustably mounted to the base. The columbarium may be preassembled at a remote location and transported for installation at the selected site.

15 Claims, 36 Drawing Sheets

(56) References Cited

U.S. PATENT DOCUMENTS 1,768,651 A * 7/1930 Wyatt ..... E04B 2/28 52/351
2,209,525 A * 7/1940 King ..... E04H 13/00 249/149
4,348,847 A * 9/1982 Jukes ..... E04B 2/8635 403/300
4,669,236 A * 6/1987 Martin ..... B28D 1/041 52/100
5,195,812 A * 3/1993 Eickhof ..... A47B 47/0091 312/257.1
5,217,622 A * 6/1993 Flores ..... E04H 13/005 210/170.01
5,692,344 A * 12/1997 Zarth ..... E04H 13/006 27/1
D395,121 S * 6/1998 Eickhof ..... D99/5
5,765,269 A 6/1998 Zarth
6,250,025 B1 * 6/2001 Darby ..... E04H 13/006 52/137
6,295,705 B1 10/2001 Gersten
D451,258 S 11/2001 Carrier
6,421,890 B1 * 7/2002 Biggar ..... A61G 17/08 220/23.83
6,634,143 B1 10/2003 Yoo
7,937,814 B2 5/2011 Voit
7,987,564 B2 * 8/2011 Leeder ..... E04H 13/008 27/1
8,209,918 B1 * 7/2012 Voit ..... E04H 13/001 52/134
9,157,252 B2 10/2015 School
2002/0092247 A1 * 7/2002 Thomas ..... E04H 13/006 52/136
2010/0180521 A1 * 7/2010 Voit ..... E04H 13/001 52/134
2012/0167488 A1 * 7/2012 Eickhof ..... E04H 13/006 52/139
2013/0199111 A1 * 8/2013 Eickhof ..... E04H 13/006 52/134
2014/0215933 A1 * 8/2014 Carlson ..... E04H 13/008 52/103
2015/0052830 A1 2/2015 School
2016/0356055 A1 * 12/2016 Trousil ..... E04H 13/006
2016/0376810 A1 * 12/2016 Eickhof ..... E04H 13/003 52/133
2017/0211291 A1 * 7/2017 Eickhof ..... A61G 17/08
2017/0298648 A1 * 10/2017 Eickhof ..... E04H 13/008

* cited by examiner

COLUMBARIUM

BACKGROUND OF THE INVENTION

Field of the Invention

The present invention is directed to a columbarium and to a method for manufacturing a columbarium system including a columbarium system with an ossuary.

Description of the Prior Art

As cost and space issues have led to fewer conventional burials and an increased number of people choosing cremation, different systems have been developed for interment of cremated remains, commonly referred to as cremains, in a dignified and respectful manner. Above ground columbarium systems have become well known and include multiple storage compartments, commonly referred to as niches, which are able to store urns in a dignified and secure manner and to withstand exposure to the elements for the extended periods of time required.

Different configurations of columbaria have been created including for outdoor use. Many columbaria are formed in substantially cylindrical, somewhat cylindrical or other multiple sided designs, including individual niches lining the periphery of the columbarium and forming exterior walls. Such generally cylindrical columbaria are free standing and provide flexibility for use in a wide variety of applications and different sites. Such columbaria create a center open space, which has generally remained empty and has not been utilized. However, it is possible that such a center space could be used as an ossuary for interring multiple separate cremated individual remains in a shared single repository vault. Moreover, such a center space may be utilized to provide a delivery system to the ossuary.

The cylindrical or somewhat cylindrical columbarium systems generally have been made with a cast concrete core and the niches are affixed around the center core. An example of such a columbarium, generally designated (20), is shown in FIGS. 2 and 3. The conventional columbarium (20) includes niches (22) located about a periphery of the columbarium (20). The columbarium includes a cover (24) and an inner core (30). The inner core (30) is a cast concrete structure and includes cast concrete bottom or base (32) and sides (34). The base (32) is set on a foundation (26). Such a configuration has generally been satisfactory for a free standing columbarium and has been suitable for outdoor uses and does not deteriorate. However, different sizes including various diameters and/or heights as well as differences needed for using the center space to provide a vault and delivery system have drastically increased the number of distinct configurations of the cast concrete cores. One drawback of such cast cores is that a mold is required for each distinct design. Therefore, in order to accommodate multiple different designs, a large storage space and a large investment in making such a large number of molds are required. Moreover, it can be appreciated that the columbaria are generally manufactured at one site and then transported for installation. The weight of concrete core (30) increases the difficulties of lifting, transporting and setting such columbaria (20) into the final resting place.

It can therefore be seen that a new and improved free standing columbarium with a hollow inner core is needed. Such a columbarium should have a flexible inner framework that can be adapted to various diameters, a variable number of sides and/or a variable height. Moreover, such a columbarium should provide a volume that allows for use as an associated ossuary without special molding required. Such a framework should be rigid enough and strong enough to accommodate the different requirements for a self-supporting free standing outdoor hollow core columbarium and be adapted for remote assembly, transport and lifting into position and mounting of the capstone and base trim while avoiding the drawbacks associated related to a concrete inner core construction. The present invention addresses these as well as other problems associated with hollow core free standing columbaria.

SUMMARY OF THE INVENTION

The present invention is directed to a columbarium and in particular to a free standing columbarium with a support framework forming an inner open vault suitable for use as an ossuary. The columbarium includes a base and a cover, such as a capstone.

The columbarium includes a center volume suitable for use as a common repository vault of an ossuary formed by a vault-type repository wall. A framework creates a center repository that may be shared by numerous cremains. In one embodiment, each individual's cremains are in its own discrete container.

It can be appreciated that according to the present invention, the total number of niches may vary and the number of sides as well as the height and the geometry of the columbarium may be varied, but an open core space is formed. The ossuary is specifically adapted for improved manufacturing and lighter weight. The framework avoids use of a cast concrete core and is easily adaptable to different configurations. A plurality of spaced apart posts mounts to the base and supports the capstone. The posts are interconnected by braces that maintain an open center area. A wall separates the niches from the ossuary. The wall may be a single element such as arcing stainless steel element or may be formed of a series of interconnected panels such as cementious fiberboard. In addition, base trim may be mounted to the concrete base of the preassembled columbarium. This allows for additional preassembly at a location remote from the installation site and also decreases the amount of site preparation work as the foundation does not require as much levelling and does not need to support the base trim elements.

The individual niches are configured for receiving one or more conventional urns. The geometry may be varied so that fewer or more urns may be placed in a single niche. As with a conventional columbarium, each individual niche may include an inscription on the front to reflect the cremains of the deceased in each niche. The configuration of the columbarium niches may vary with regard to the number of sides, the height and the total number of niches. The niches are generally each configured with sidewalls, a top and a bottom. It can be appreciated that for the stacked layers of niches, the ceiling of one niche may form the floor of the niche just above it. An inner cover may be used that provides a weather tight enclosure at the outer face of the niche and a weather tight storage compartment. An outer stone shutter is removably placed over each niche with mounting hardware. Such hardware is hidden by the stone shutters and provides for adjustably and removably mounting each shutter for inserting the cremains and also as may be needed while the shutter is removed to add inscriptions.

Moreover, the present invention includes a delivery system configured for delivering cremated remains into the center ossuary in a dignified manner. In one embodiment, the delivery system includes a pivoting chute or slide and a handle as well as hinge or pivot. The hinge allows for the slide to be rotated between a raised position and lowered position. In the lowered position, an inner portion of the slide extends into the access niche while a second inner portion extends beyond the rear of the access niche and into the inner shared repository of the ossuary. A fixed slide or ramp may also be used to direct remains into the ossuary.

The columbarium and inner ossuary includes a memorial band in some embodiments provide space for inscriptions in memoriam of cremated remains that are interred in the ossuary or in a niche behind the memorial band and for which there is not a corresponding inscription elsewhere. The memorial band includes a plurality of panels removably mounted with hardware similar to that used for the niches. A memorial band panel may be removed to add or update inscriptions as may be necessary and then replaced. It can further be appreciated that the memorial band may protrude outward further than outer surface of the stone shutters to provide a further degree of contrast. To further set the memorial band apart from the other stone surfaces, a contrasting color and/or different type of stone and/or different finish may be utilized for the memorial band. The contrast provides for easily locating and distinguishing the memorial band from the individual niches. It can be appreciated that in some embodiments, the memorial band panels extend across the width of several individual niches. However in other embodiments, the memorial band panel is the same width as individual niches. It can be appreciated that in some embodiments, the base or other areas may be utilized for inscriptions depending upon the particular configuration, the stone used, and/or whether the columbarium is outdoors or is protected from the elements.

The ossuary is suited for receiving flexible urns. A flexible urn includes a closable bag portion. The bag portion may include an impermeable liner and a decorative layer. The outer decorative layer may also include an inner fabric liner. The outer decorative layer may be made from satin, velvet or other appropriate fabrics providing a dignified appearance. Moreover, the outer layer may be embroidered and/or may include other graphics, such as religious symbols, as may be desired. The impermeable layer is sealed so that the cremated remains are safely contained within the impermeable liner of the bag. A decorative cord or other closure closes the outer bag layer around the impermeable layer and provides protection of the impermeable layer to avoid tearing, puncture or other damage and prevents any cremated remains from escaping from the flexible-type urn.

A flexible urn may be put into the ossuary through an access niche at or near the top of the columbarium and the delivery system. While being used for delivery of flexible urns into the ossuary, each access niche will typically not have an inscription on its outer stone shutter and will not store remains. However, it can be appreciated that after the ossuary is full or the particular access niche is no longer needed for providing delivery of flexible urns, the access niche may be used for storing individual conventional urns. The columbarium includes at least one delivery system, although depending on size, more delivery systems and access niches could be utilized.

For a memorial ceremony and interment of cremains deposited in the inner ossuary, the stone shutter and the inner panel of one of the access niches are removed. A flexible urn is delivered onto the chute and slides into the ossuary. The flexible urn then descends along the slide and drops into the open vault of the ossuary. The inner portion of the slide closes off the rear of the access niche to provide added security and separation of the vault and the access niche. After the cremains are deposited, the inner cover and outer stone shutter are replaced and the columbarium retains its fully closed appearance. Separately, one of the memorial band panels is removed to add an inscription to reflect the interment into the ossuary.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

Figure 1:
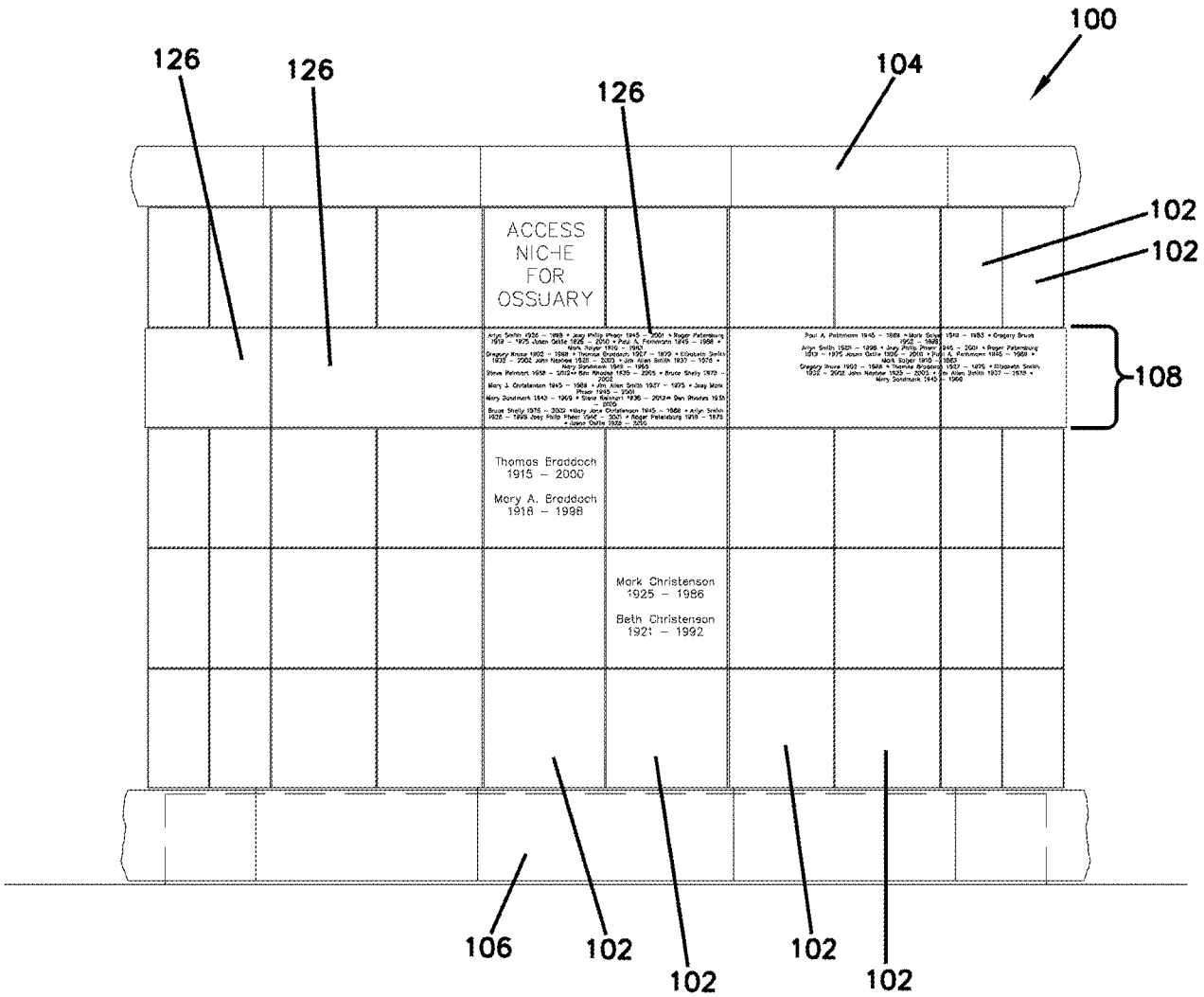
FIG. 1 is a side elevational view of a first embodiment of a columbarium according to the principles of the present invention.
Figure 2:
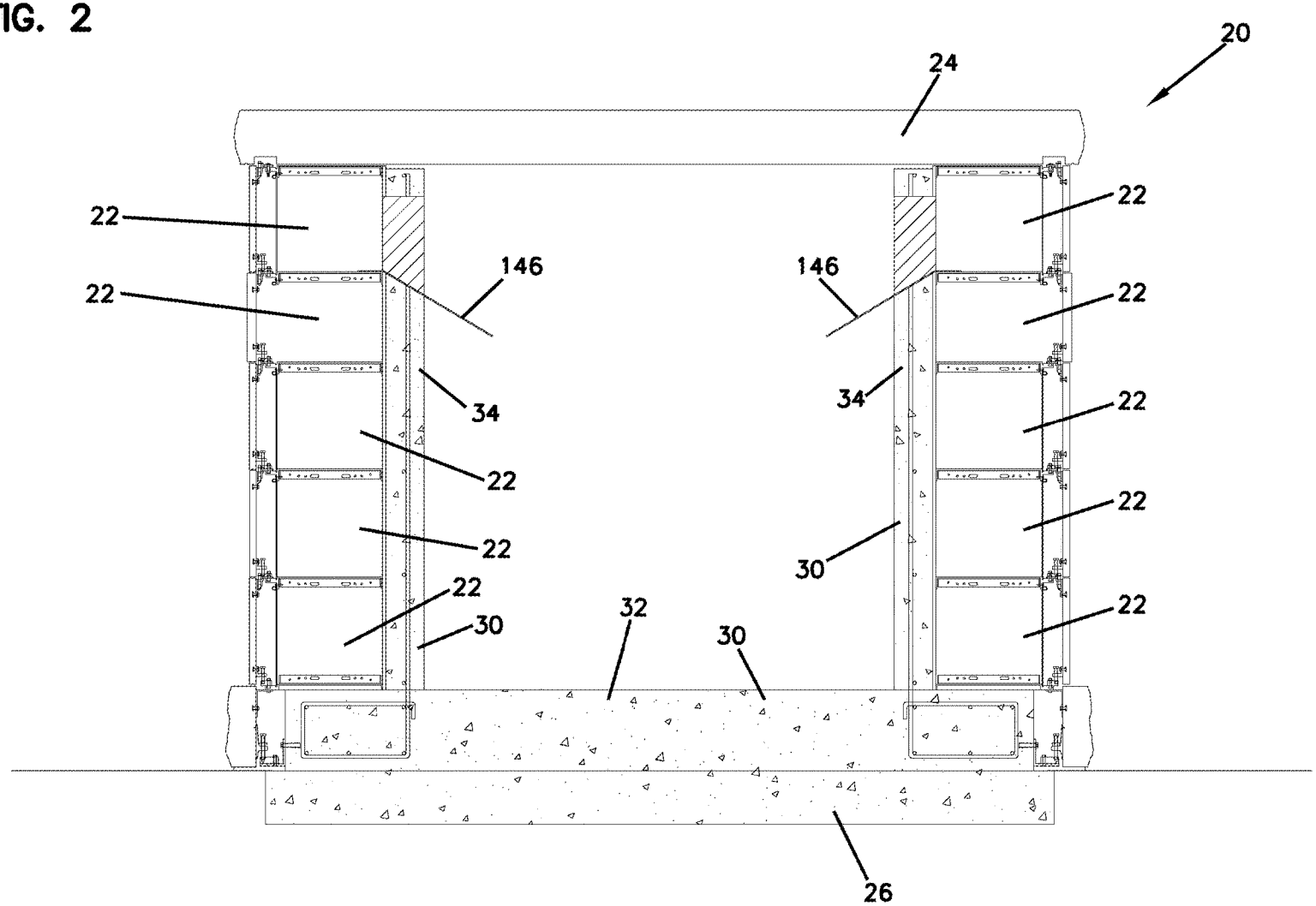
FIG. 2 is sectional view of a prior art columbarium having a cast concrete core.
Figure 3:
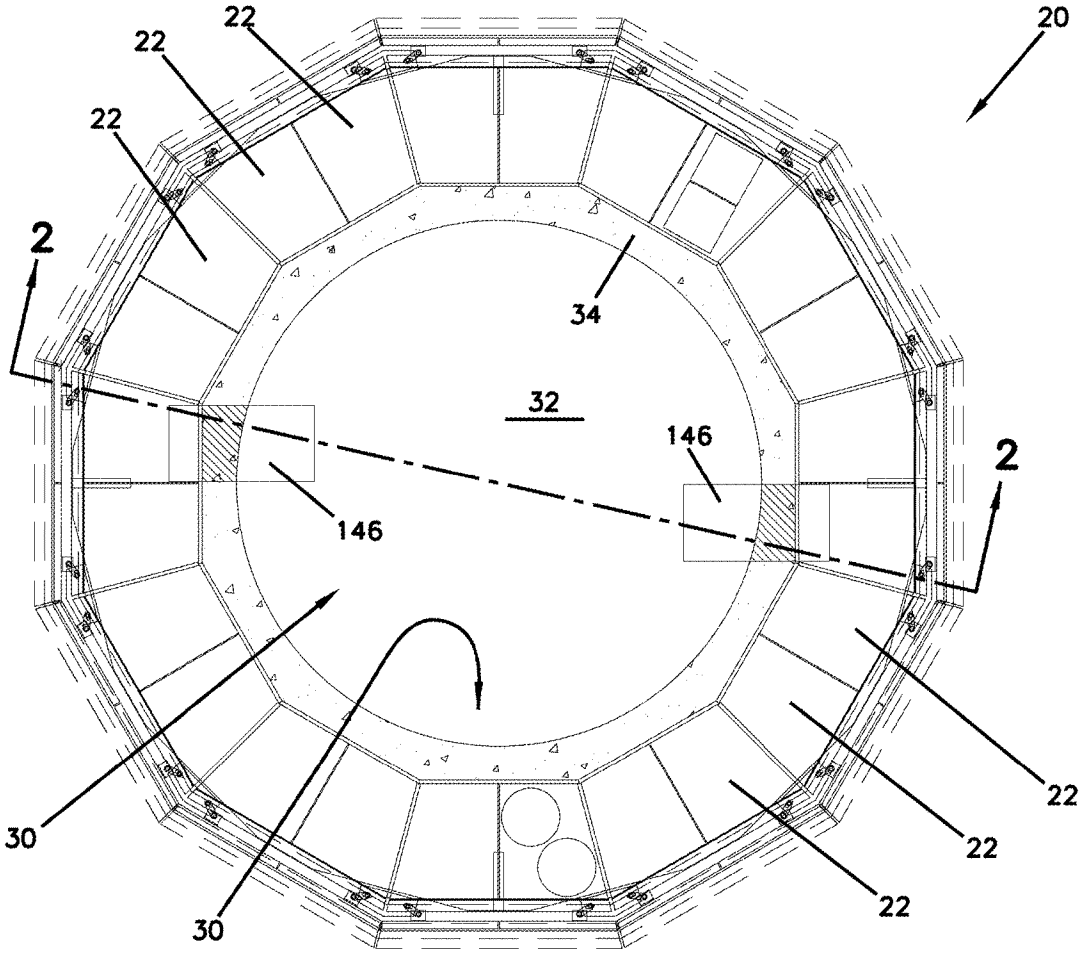
FIG. 3 is a top plan view of the prior art columbarium shown in FIG. 2.

Referring now to the drawings and in particular to FIG. 1, there is shown a first embodiment of a columbarium, generally designated (100). In the embodiment shown, the columbarium (100) is substantially cylindrical with a plurality of niches (102) disposed about a periphery of the columbarium. As shown more clearly in FIGS. 4 and 5, each of the niches (102) provides a compartment for storing an urn or a small number of urns in a dignified manner. The columbarium (100) also includes a cover such as a capstone (104) and a base (106) typically made of concrete that may be permanently installed on the ground or a foundation (118). In the embodiment shown, the columbarium (100) includes 96 individual niches (102), although the size of the columbarium and the number of sides can be varied to change the total number of niches (102).

Each of the niches (102) includes a cover, typically a decorative stone shutter, such as a granite or marble shutter. With the somewhat cylindrical configuration of the columbarium (100), each niche (102) wider at the outer face and includes panels forming sidewalls (112) that extend radially inward and slightly toward one another. Each niche (102) is enclosed by a top (114) and a bottom (116). For additional security and protection from the elements, the niches (102) may include an inner cover (120). The shutters (110) are removable and generally held and aligned by hidden mounting hardware (122) that provides alignment and for removal and reattachment of the shutters (110) as may be required when remains are placed in the niche (102). It can be appreciated that all elements of the columbarium (100) are made of weather resistant materials that won't degrade when exposed to the elements and will last for the extended lifetime required of a columbarium (100).

In the embodiment shown, a memorial band (108) is formed near the top of the columbarium (100). The memorial band (108) includes memorial band panels (126). The memorial band panels (126) are also formed of a decorative stone material. The memorial band (108) may extend radially outward beyond the outer faces of the niches (102) to provide a contrasting appearance to the shutters (110). The memorial band panels (126) may also be of a different color and/or material than the other shutters. Moreover, the memorial band panels (126) may cover two or more individual niches (102) and/or have a different height and/or width. The memorial band panels (126) provide an area for identifying individuals' remains held in niches behind the memorial band panels (126) as well as those who may be stored in the inner vault of an ossuary (130), as explained hereinafter.

Figure 4:
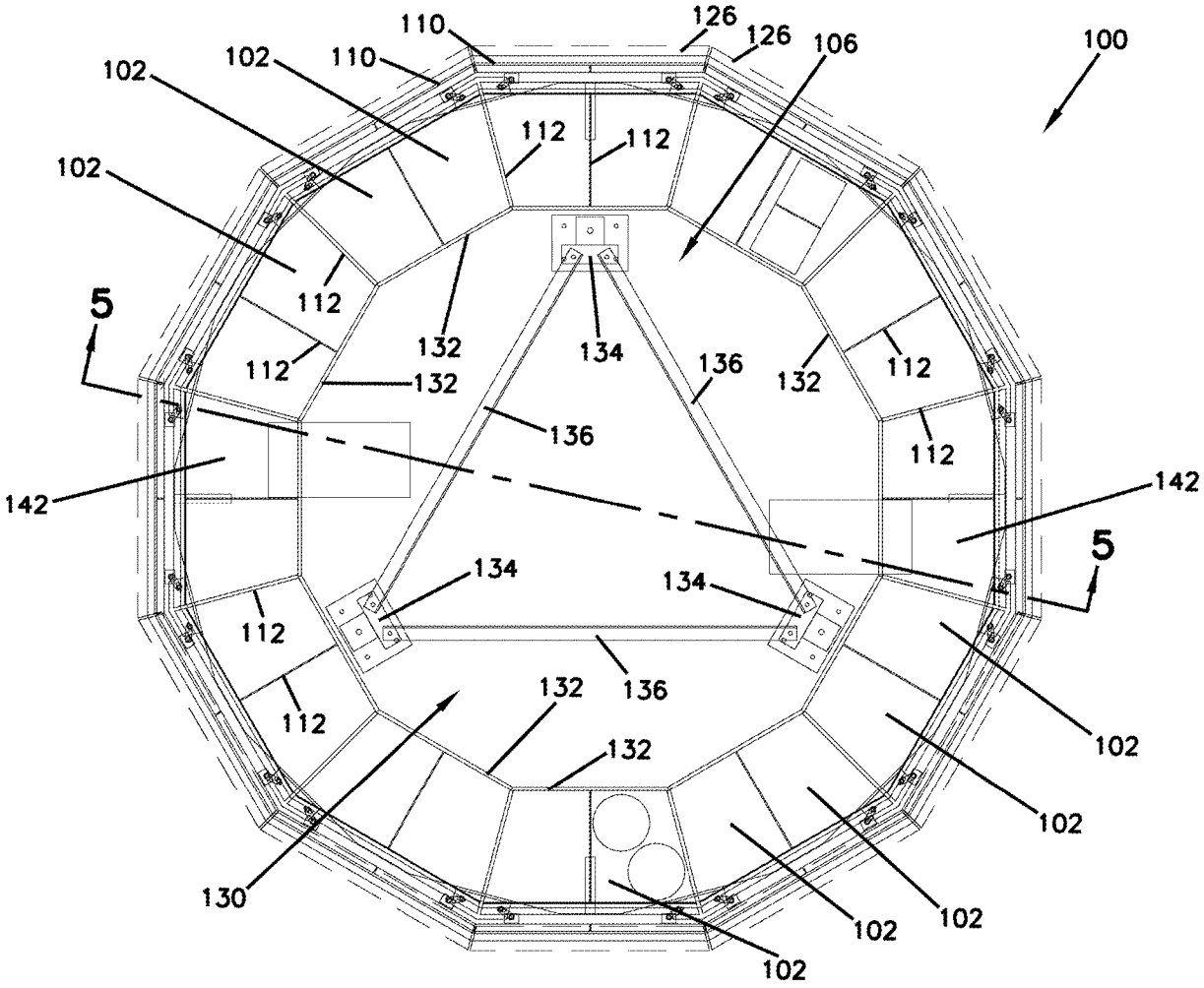
FIG. 4 is a top plan view of the columbarium shown in FIG. 1 with the cap stone removed for clarity.
Figure 5:
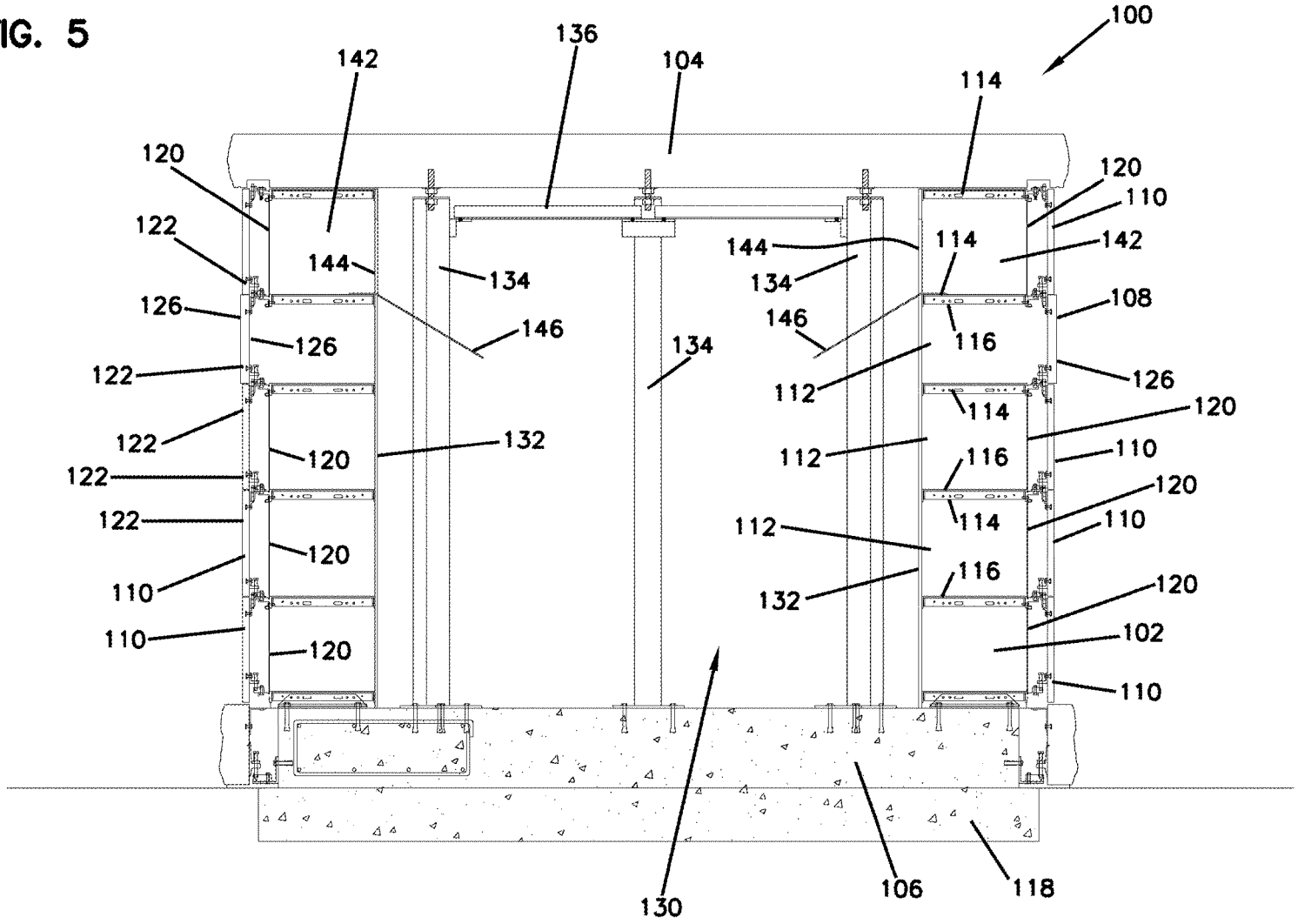
FIG. 5 is a side sectional view of the columbarium shown in FIG. 4.

As shown most clearly in FIGS. 4 and 5, the columbarium (100) defines an open inner chamber that forms a vault serving as an ossuary (130). The ossuary (130) includes support posts (134) that mount to the base (106) and also support the capstone (104) as well as providing rigidity. The posts (134) are connected by frame members (136) to form an internal frame. An inner wall (132) extends around the inner wall of the niches (102) to form an enclosed space. The inner wall (132) may be formed of panels such as concrete fiberboard or may be a stainless steel element that is formed into a somewhat circular shape. However, the outline of the inner wall may be other common polygon shapes. It can be appreciated that the posts (134) and brace members (136) form a framework that includes a central continuous open volume enclosed by the inner wall (132), as shown in FIGS. 4 and 5. The support posts (134) are preferably made of a strong and weather resistant material such as stainless steel or other alloys that won't degrade in a columbarium exposed to the elements.

Figure 6:
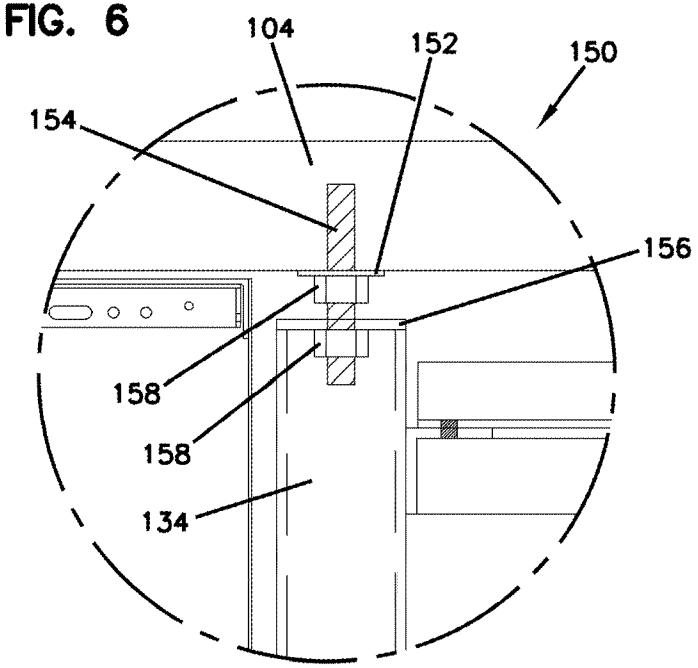
FIG. 6 is a section detail view of the capstone connection for the columbarium shown in FIG. 1.

As shown in FIG. 6, the top of the post (134) includes mounting hardware (150) including a mounting plate (152), a rod (154) and a cap plate (156). The rod also includes hex-type nuts (158) that provide for height adjustment so the capstone (104) is level and properly supported and placed.

Figure 7:
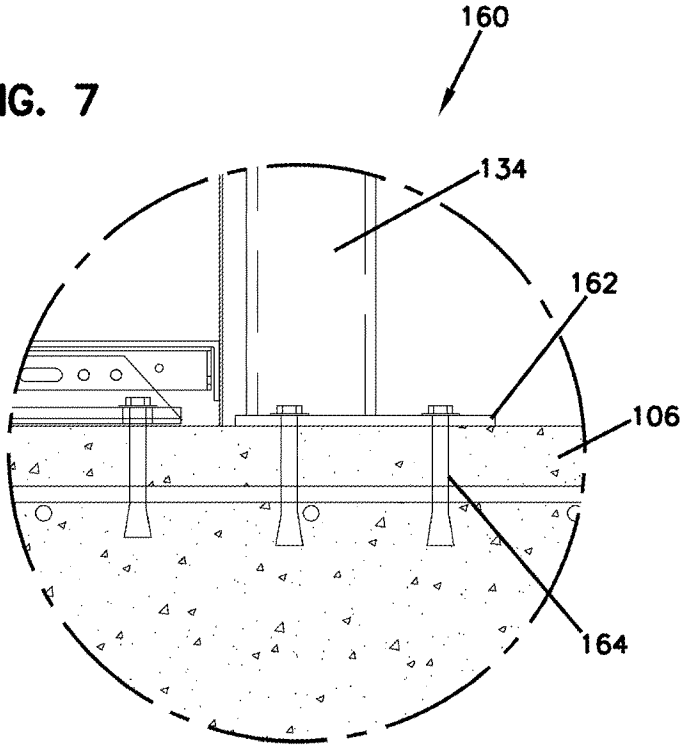
FIG. 7 is a section detail view of the base connection for the columbarium shown in FIG. 1.

Referring now to FIG. 7, base mounting hardware (160) provides for securely mounting the posts (134) to the concrete base (106). The post (134) includes a base plate/bracket (162). Bolts or anchors (164) mount the base plate (162) to the concrete base (106).

Figure 13:
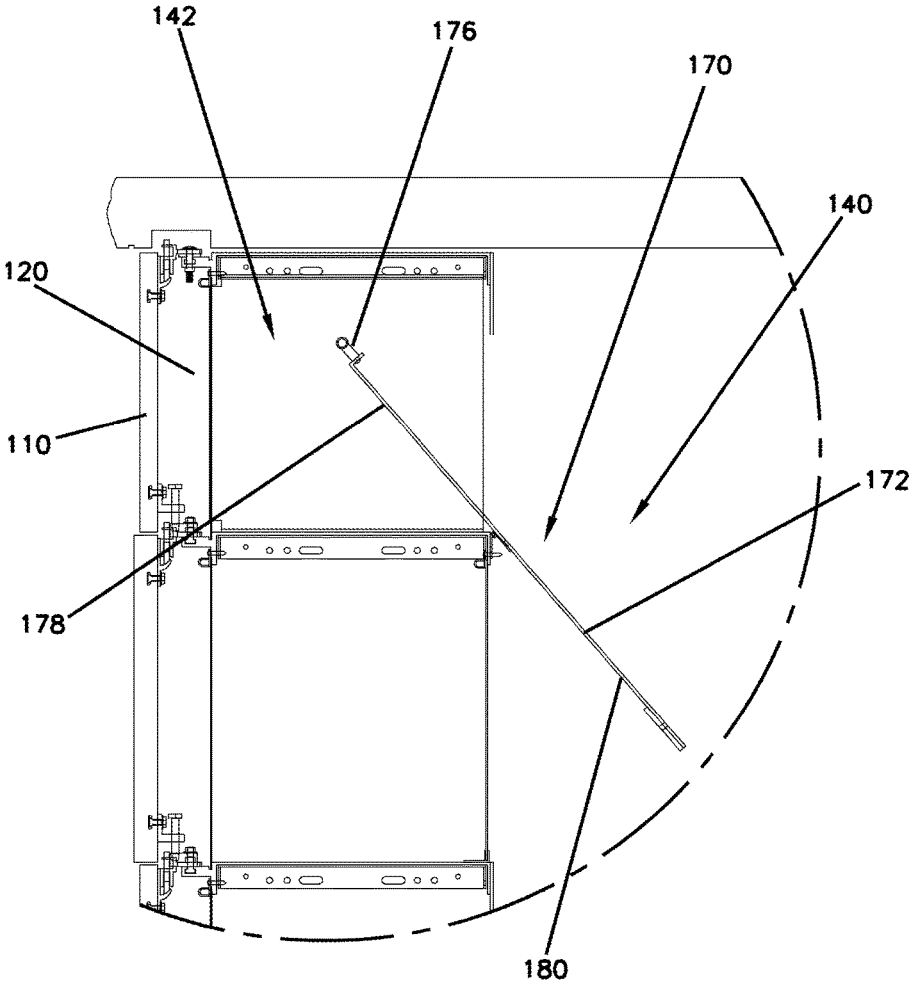
FIG. 13 is a side sectional view of a first embodiment of a delivery assembly for delivering flexible cremains containers.
Figure 14:
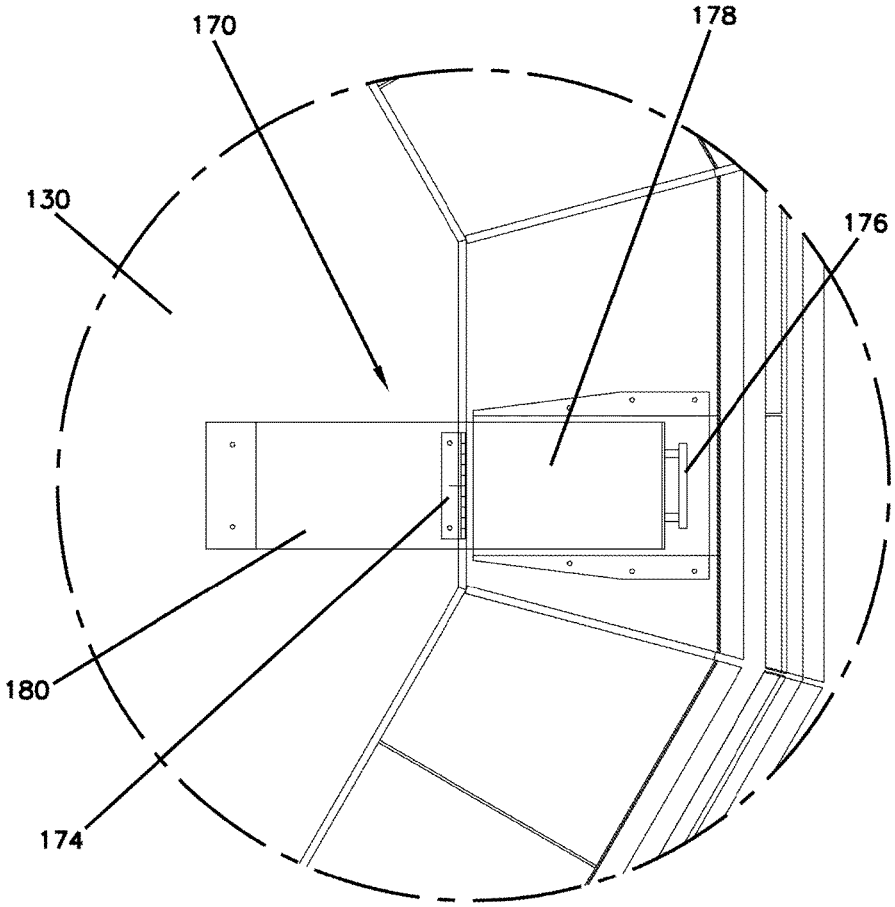
FIG. 14 is a top view of the delivery assembly mounted in the columbarium of FIG. 1.

In the embodiment shown in FIGS. 1-5, the ossuary (130) also includes a fixed delivery system for delivering cremated remains in suitable containers into the ossuary (130). As shown in FIGS. 13 and 14, a first embodiment of a deposit system (140) includes one or more access niches (142). The access niche (142) includes a removable access panel (144) at the rear of the niche (142), as shown in FIG. 5. A chute or slide (146) provides for directing a generally flexible cremated remains container into the ossuary (130). Therefore, the remains may be placed in the ossuary (130) by removing the shutter (110) and inner cover (120) of the access niche (142) and the access panel (144). Remains may then be placed on the chute (146) and slide in a dignified manner into the ossuary (130). Once the remains have been directed into the ossuary, the covers and panels may be replaced. As there may be a large number of remains stored in the ossuary (130), it can be appreciated that the memorial band (108) provides space for identifying the remains for those who have been interred in the ossuary (130). However, it can be appreciated that identifying information may also be placed on the capstone (104), around the base or even on bricks, pavers or panels surrounding the columbarium (100). It is also possible to have a separate wall or structure that provides space for recording names thereon.

Figure 11:
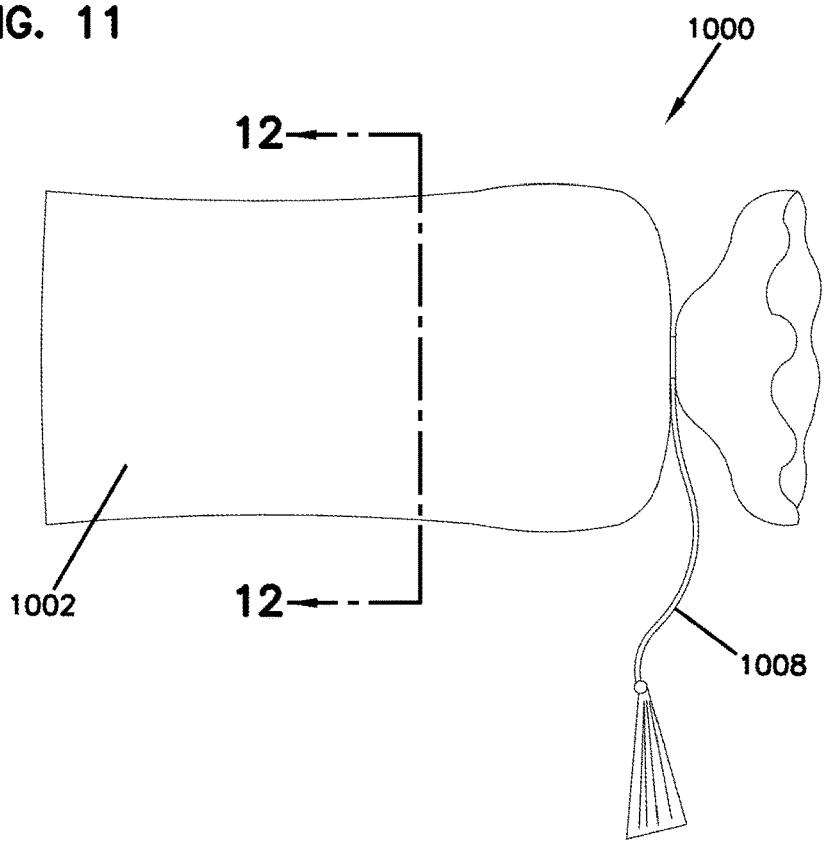
FIG. 11 is a side elevational view of a flexible cremains container for use with the columbarium and ossuary system shown in FIG. 1.
Figure 12:
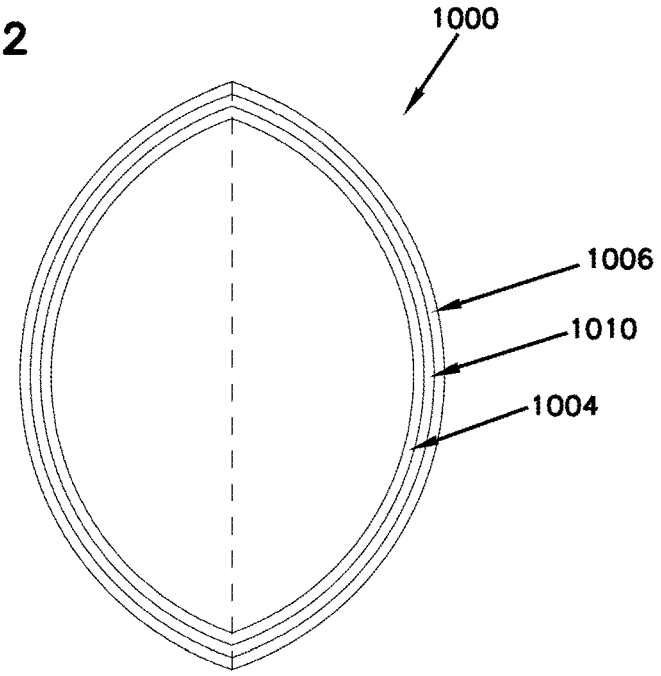
FIG. 12 is a side sectional view taken along line 12-12 of FIG. 11.

Referring now to FIGS. 11 and 12, the ossuary is specifically adapted for receiving flexible type urns (1000). The flexible urn (1000) includes a closable bag portion (1002). In a preferred embodiment, the bag portion (1002) includes an impermeable liner (1004) and an outer decorative layer (1006), as shown in FIG. 7. The outer decorative layer (1006) may also include an inner fabric liner (1010). The outer decorative layer (1006) may be made from satin, velvet or other appropriate fabrics providing a dignified appearance. Moreover, the outer layer (1006) may be embroidered and/or may include other graphics, such as religious symbols, as may be desired. The impermeable layer (1004) is sealed so that the cremated remains are safely contained within the impermeable liner (1004) of the bag (1002). A decorative cord or other closure (1008) closes the outer bag layer (1006) around the impermeable layer (1004) and provides protection of the impermeable layer (1004) to avoid tearing, puncture or other damage and prevents any cremated remains from escaping from the flexible-type urn (1000).

Figure 8:
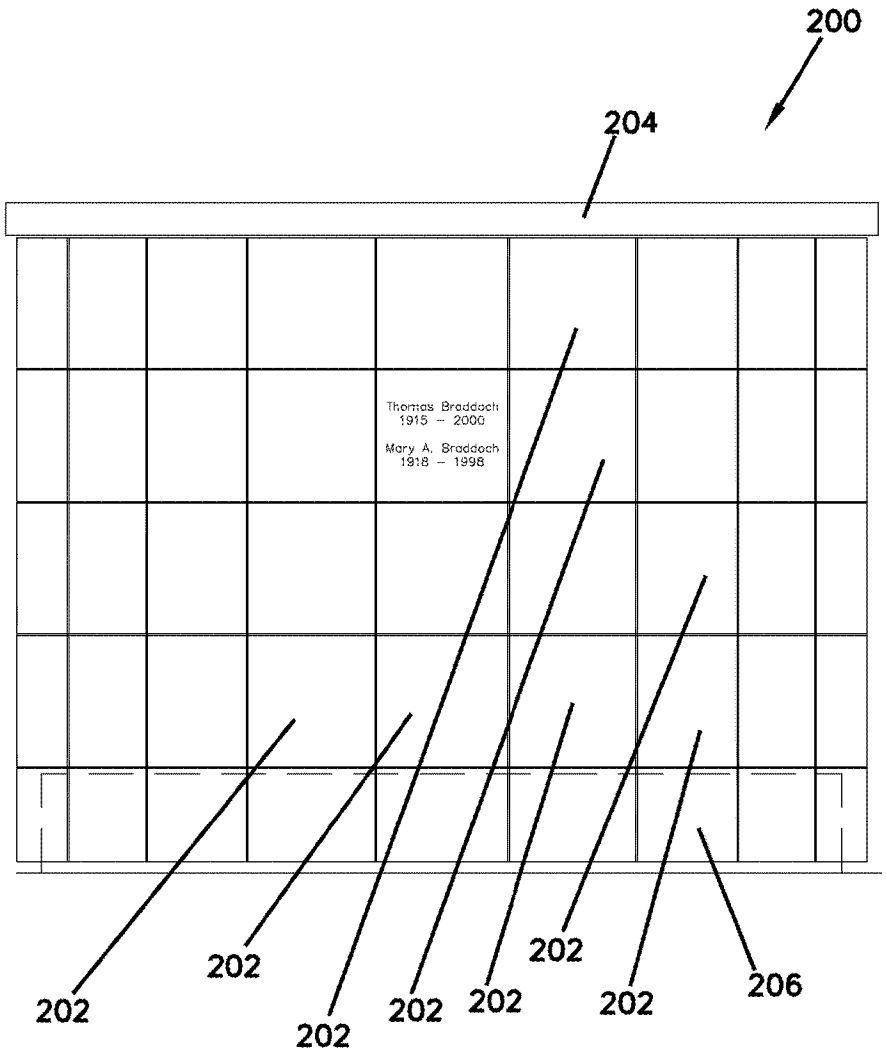
FIG. 8 is a side elevational view of a second embodiment of a columbarium according to the principles of the present invention.
Figure 9:
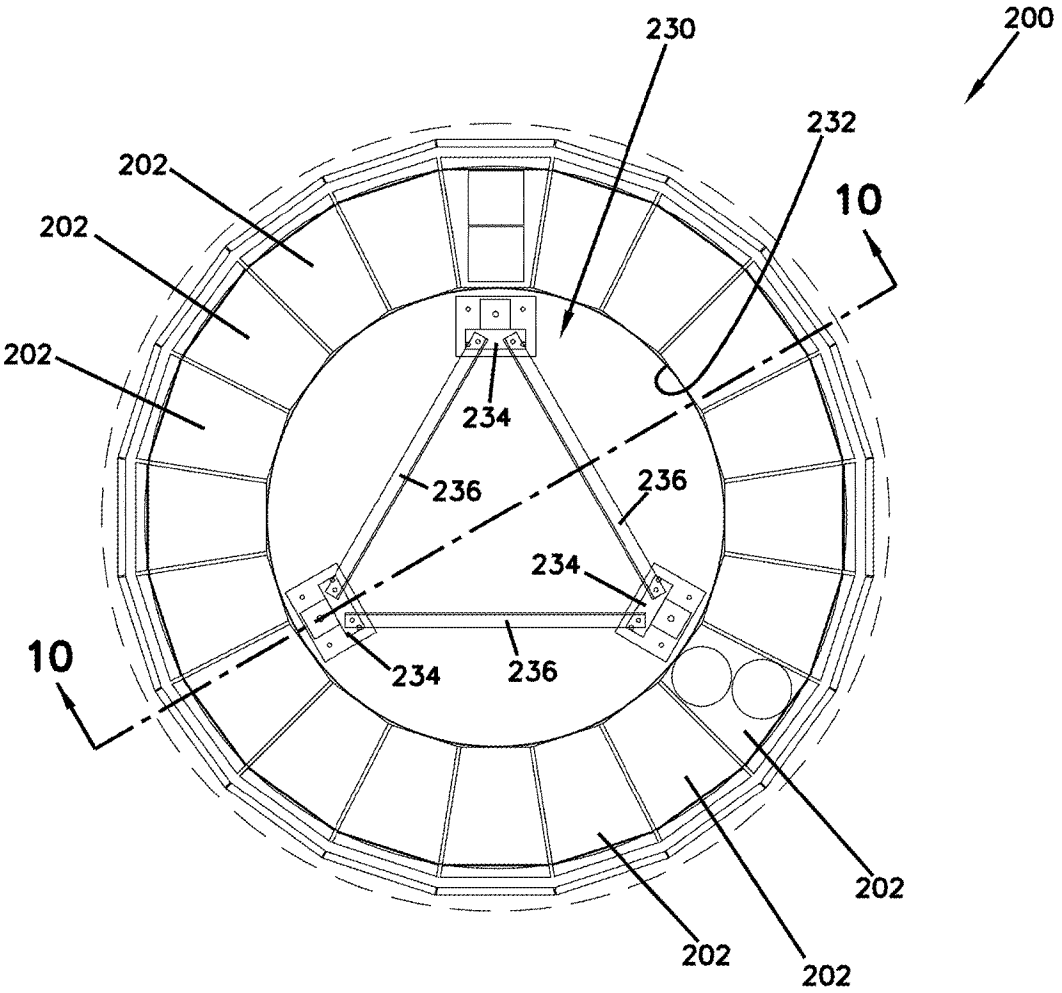
FIG. 9 is a top plan view of the columbarium shown in FIG. 8 with the cap stone removed for clarity.
Figure 10:
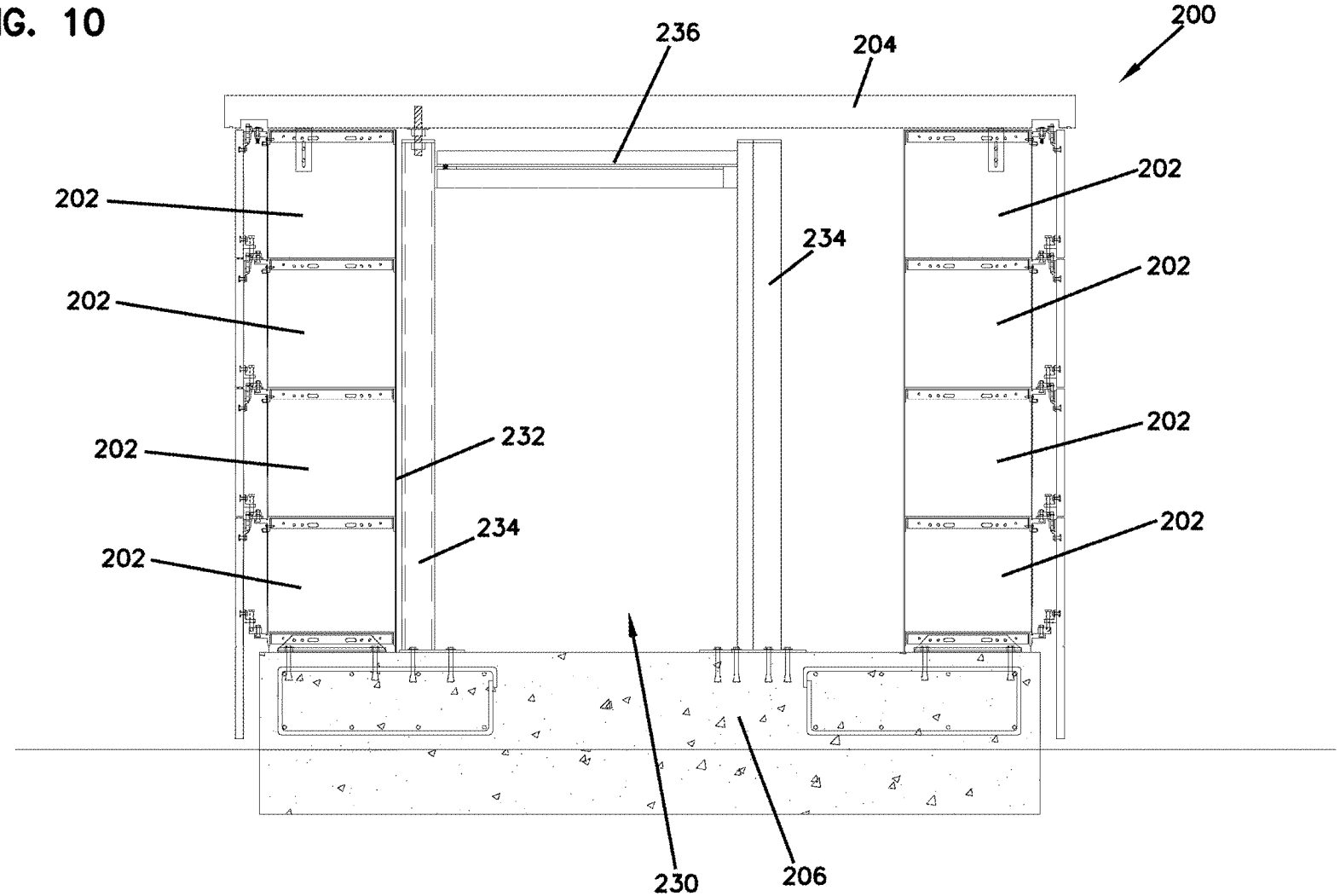
FIG. 10 is a side sectional view of the columbarium shown in FIG. 9.

Referring now to FIGS. 8-10, there is shown a second embodiment of a columbarium, generally designated (200). The columbarium (200) is generally cylindrical and similar to the columbarium (100) except in the number of niches (202) as well as the dimensions and outer shape and geometry. The columbarium (200) includes 80 niches (202), which are arranged about a periphery of the columbarium (200) and four levels. The columbarium (200) also includes a cover (204) and a base (206). In the embodiment shown in FIGS. 8-10, the columbarium (200) does not include a memorial band or an inner ossuary. However, it can be appreciated that such features could be incorporated into the columbarium (200) in a configuration similar to that for the columbarium (100) by converting one of the niches (202) into an access niche and adding a delivery chute. It can also be appreciated that the columbarium (200) has a more cylindrical configuration with 20 niches on each level as compared to the embodiment shown in FIGS. 1 and 4-5 that includes 24 niches on each level as well as a memorial band. Moreover, the configuration shown in FIG. 1 has 2 niches on each side for a total of 12 sides while the columbarium (200) includes individual niches with 20 separate sides. The columbarium (200) also includes more rounded interior wall, which is generally more conducive to a stainless steel inner wall element (232). The posts (234) and frame members (236) for the inner ossuary (230) may be similar to those of the columbarium (100). It can be appreciated that although the embodiments shown include three support posts and braces, for different sizes, a different number of support posts may be utilized. It can also be appreciated that in certain areas where there is a threat of seismic activity, additional bracing as shown where framework may be needed and the ossuary may include 4, 5 or more spaced-apart vertical posts.

Figure 19:
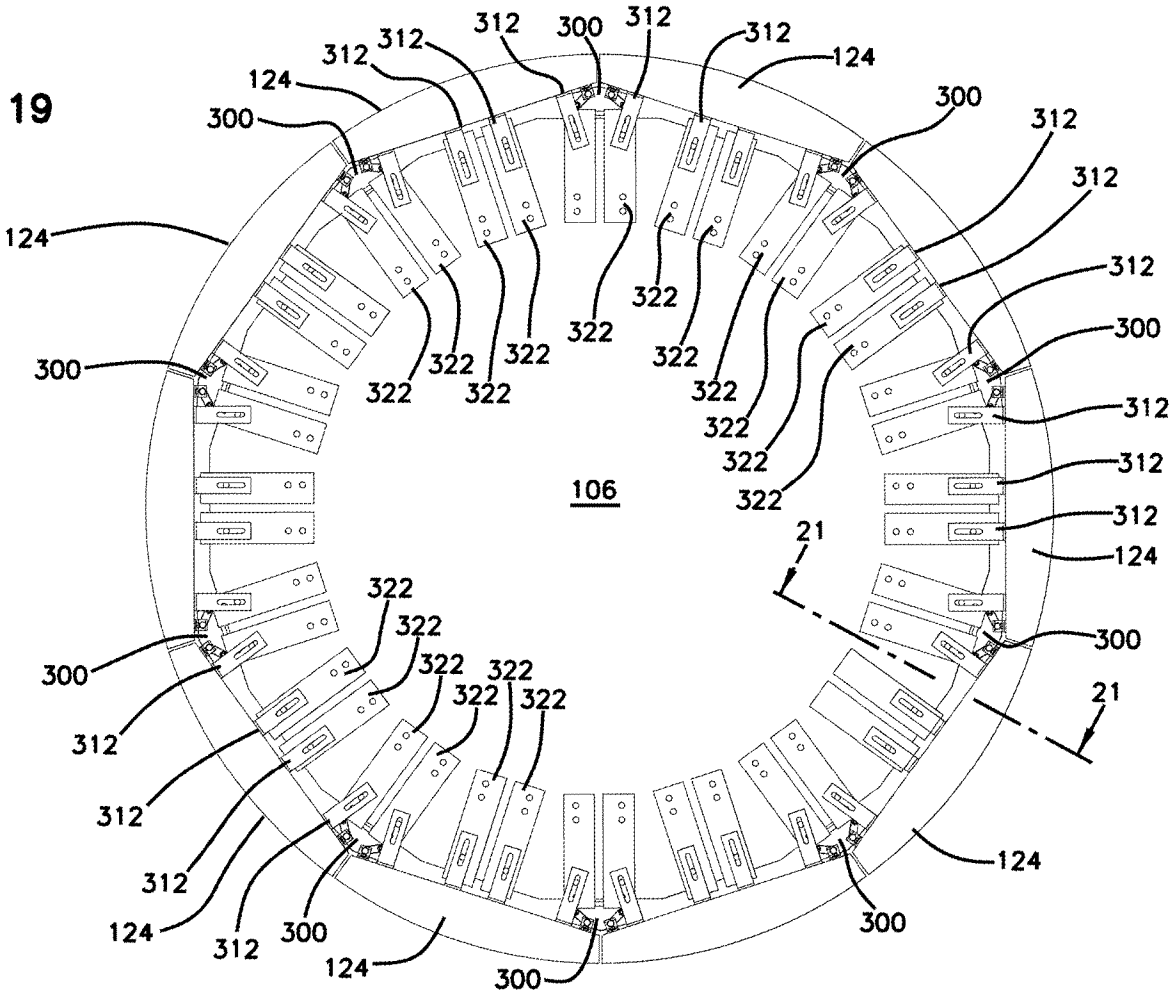
FIG. 19 is a top plan view of a first embodiment of base trim elements and mounting hardware mounting to the base of a columbarium
Figure 20:
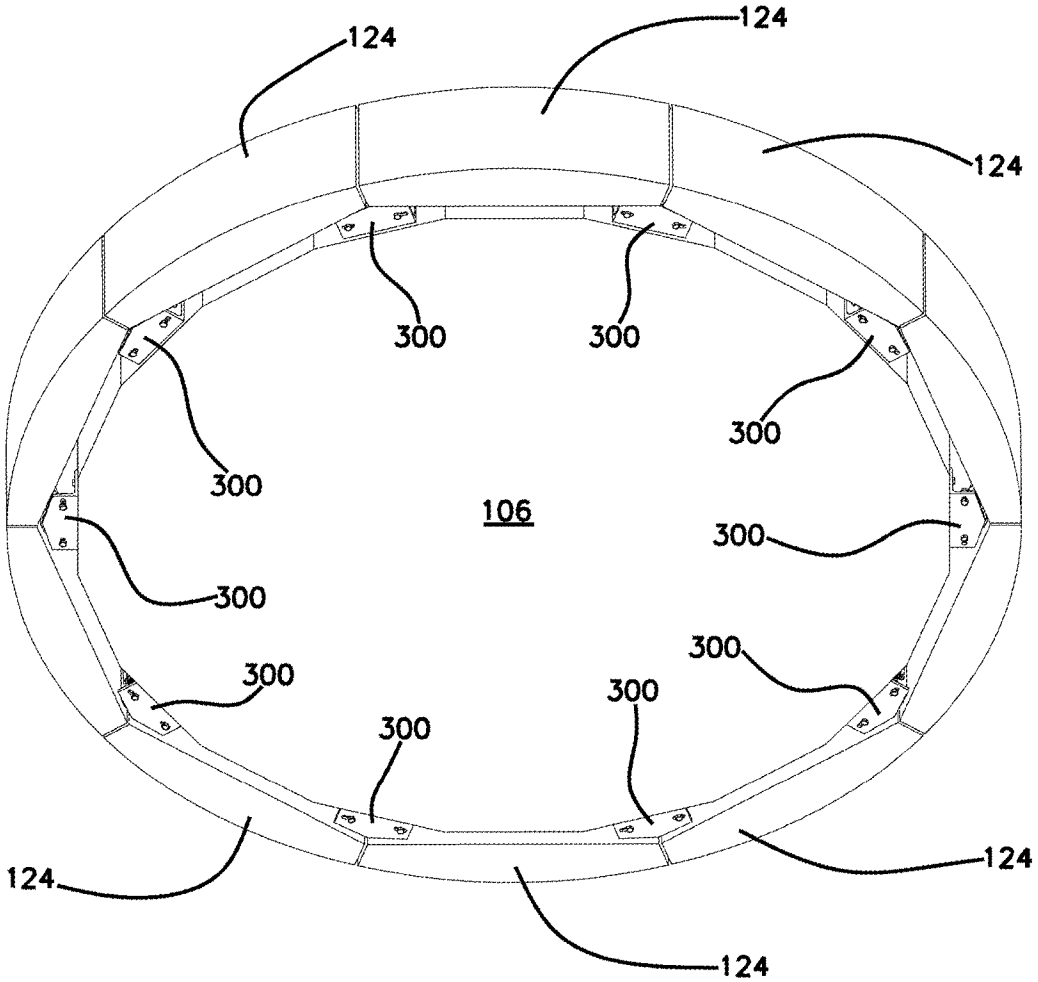
FIG. 20 is a bottom perspective view of the base trim elements, mounting hardware and base shown in FIG. 19.

Referring now to FIGS. 19 and 20, the mounting of the base trim elements (124) at the base (106) is shown. Mounting is accomplished with mounting assemblies (300) spaced apart about the periphery of the base (106). Each base assembly (300) attaches to ends of two adjacent edge trim pieces (124). Moreover, top edges of the base trim elements (124) retained by brackets (312) mount to the top of the base (106).

Figure 21:
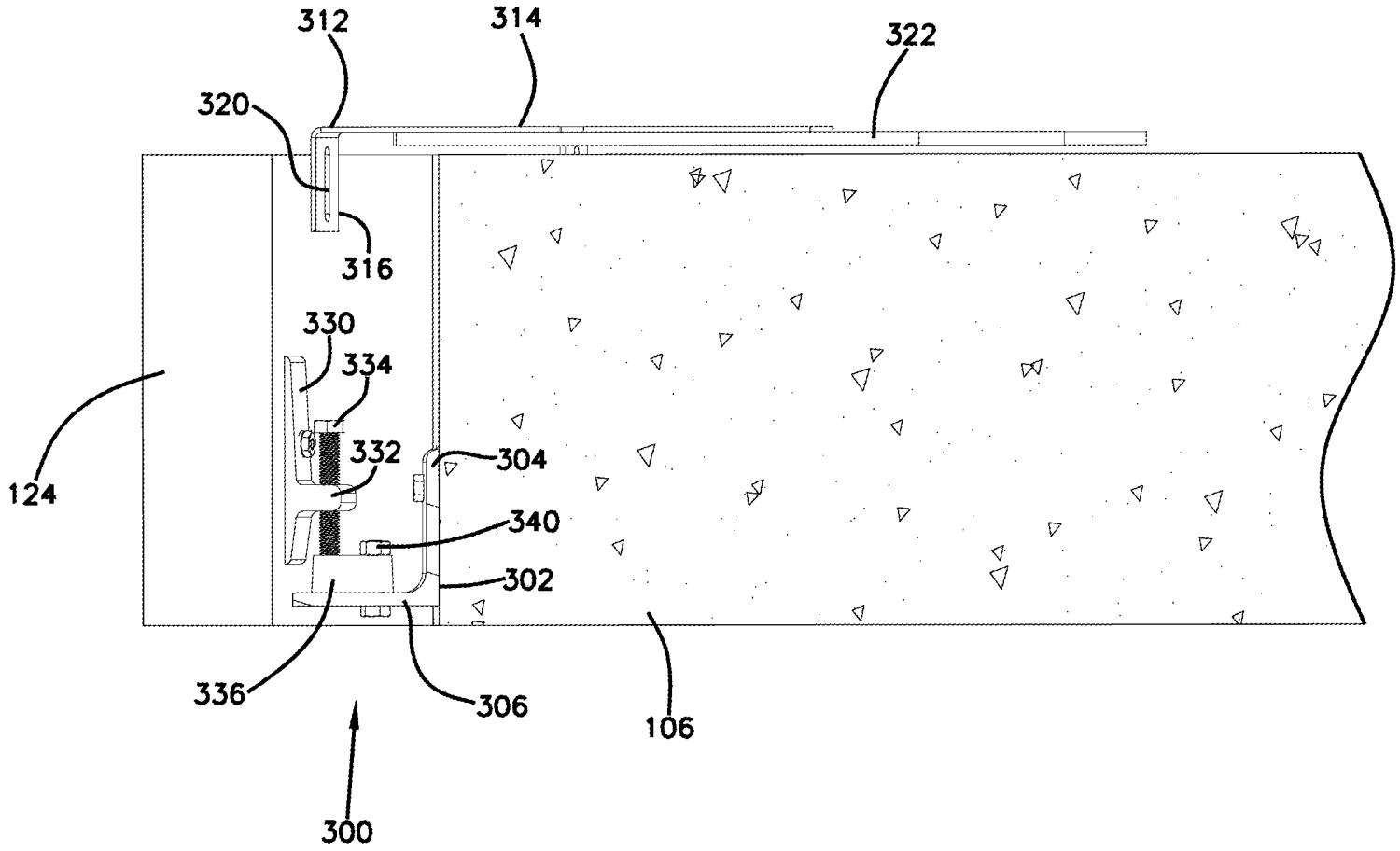
FIG. 21 is a side sectional view taken along line 21-21 of FIG. 19 showing the base trim elements, mounting hardware and base.
Figure 22:
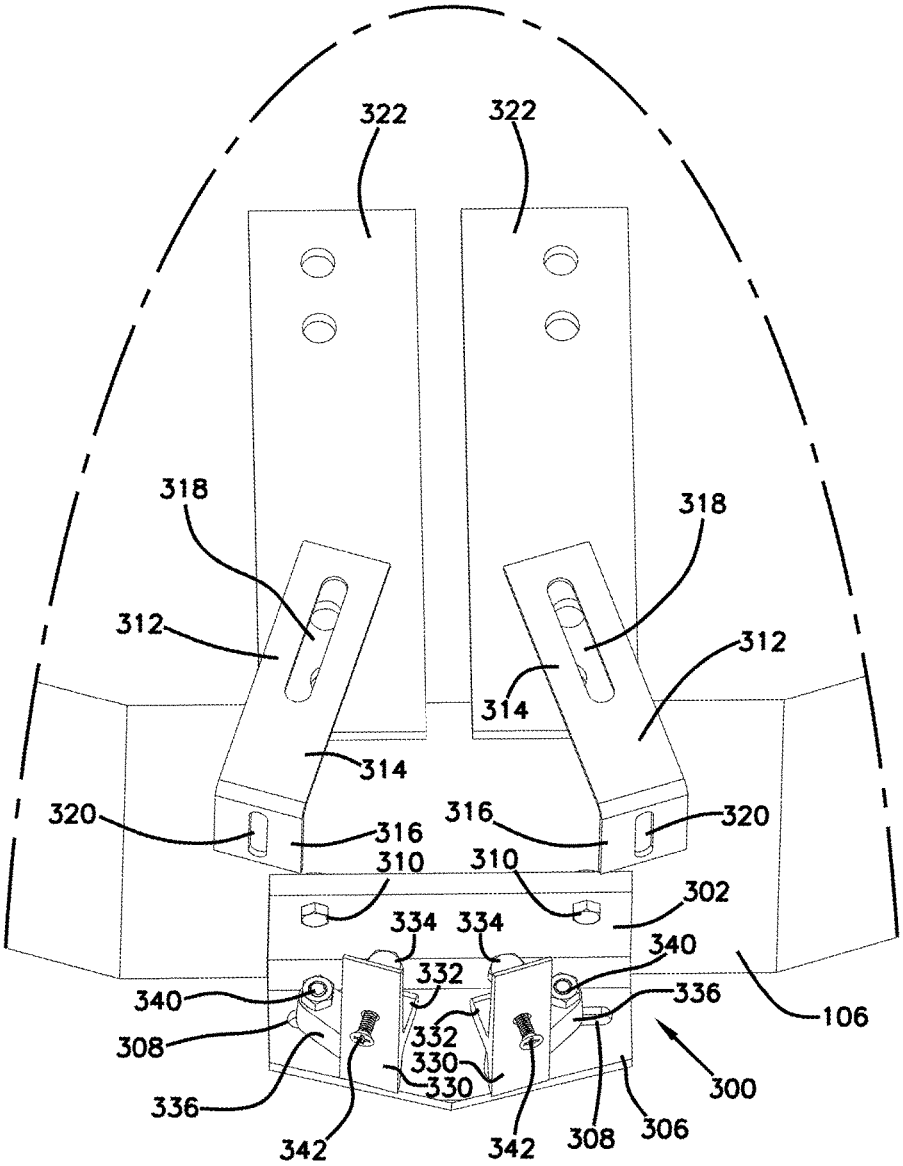
FIG. 22 is a top perspective view of the base trim mounting hardware and base shown in FIG. 19.
Figure 23:
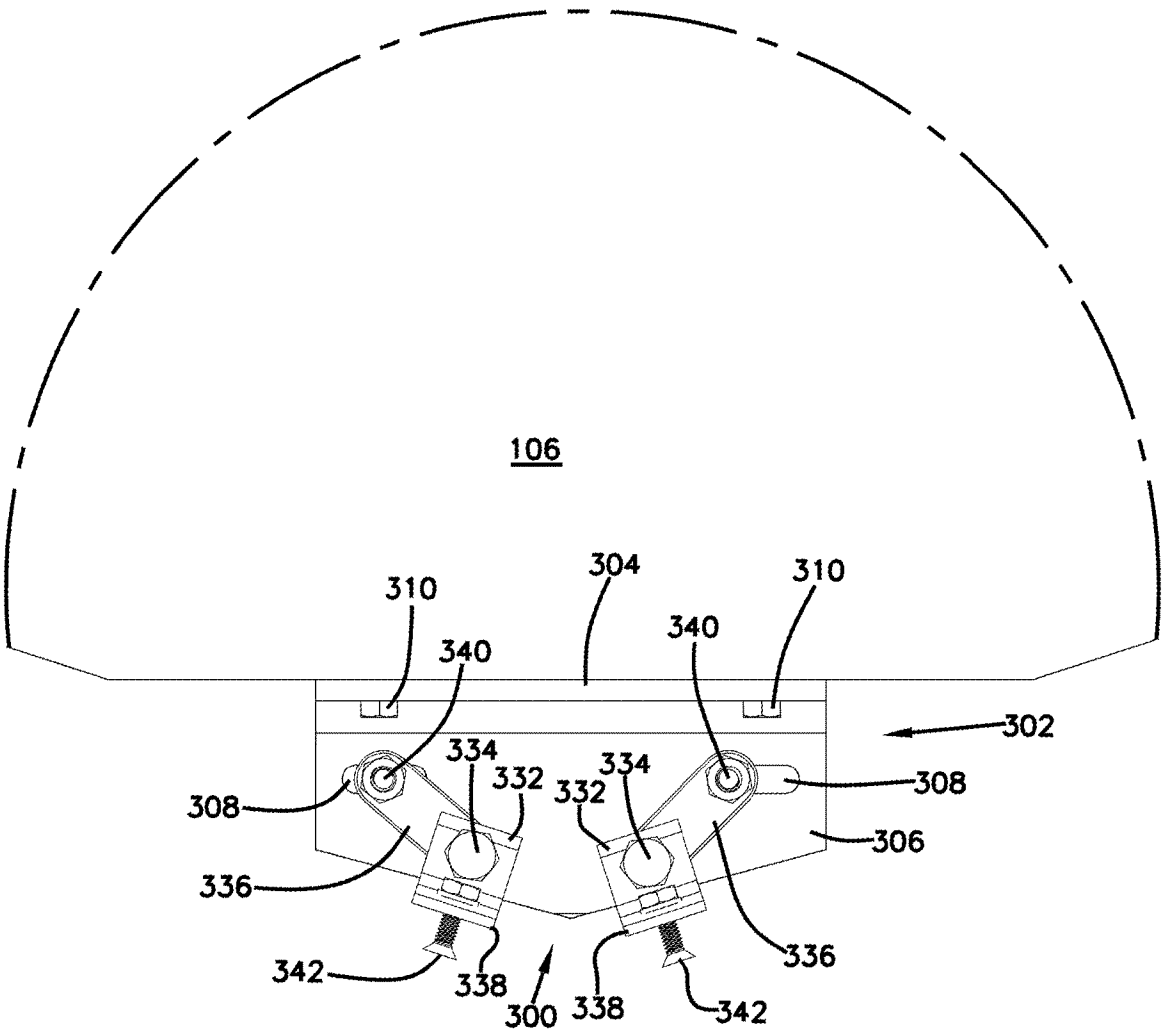
FIG. 23 is a top plan view of the base trim mounting hardware and base shown in FIG. 19.

Referring now to FIGS. 21-23, each base trim mounting assembly (300) includes a mounting plate (302) having a vertical portion (304) and a bottom flange (306) extending radially outward from the vertical portion. The vertical portion is configured to mount against the outer face of the base (106) with mounting bolts (310).

The bottom flange includes slots (308) that receive a lug (340) that provides for vertical mounting and horizontal adjustment of the base trim elements (124). Upper mounting brackets (312) include an upper horizontal portion (314) attaching to mounting supports (322) on top of the base (106). The upper base trim mounting brackets (312) also include a downward extending flange (316). The upper portion (314) includes a slot (318) while the flange (316) includes a second slot (320). The slots (318 and 320) receive mounting bolts (not shown for clarity) and provide for rotation relative to the base mounting supports (322) and to radial and vertical adjustment to align the base trim elements (124) about multiple axes. The base trim elements are also supported by hangers (330) including the projecting leg (332) extending radially inward from the hanger (330). The hangers (330) attach to base trim elements with mounting bolts (342). Threaded studs (334) extend through the threaded opening in the projecting leg (332) and are received in a socket of a swivel socket (336). The swivel socket (336) also includes apertures receiving the lugs (340). The threaded studs (334) provide for vertical adjustment of the base trim relative to the swivel socket (336). Moreover, the swivel socket (336) may be rotated inward or outward and slid along the slots (308) to provide for lateral and/or radial adjustment of the base trim elements (124). The hardware elements are made of a weatherproof and corrosion resistant material such as stainless steel that has the long life necessary for columbaria. It can be appreciated that the mounting system (300) provides for adjustment of each base trim element (124) vertically, horizontally, inward and outward, and laterally. Therefore, each end of the base trim elements (124) may be positioned in all axes relative to the base (106) and to adjoining base trim elements for improved fit and alignment.

It can also be appreciated that prior mounting systems and techniques required installation at the site without adjustment being possible. The base trim mounting system (300) of the present invention allows for attachment of the base trim elements either at the installation site or at a remote location. Therefore, the core may be assembled elsewhere and the base trim elements (124) or select base trim elements, as may need to be removed for transport, later added. The present invention therefore provides for greater flexibility for manufacturing that can be tailored to the requirements of the installation site as well as the transportation modes available.

It can be appreciated that the columbaria according to the present invention provide for improved manufacturing. The columbaria of the present invention may have the cores assembled remotely and the niches mounted to the core and on the base. Moreover, trim for the base (124) typically must be added at the installation site as it is supported by the foundation. However, the columbarium of the present invention has base trim elements (124) mounted to the base (106) with mounting assemblies (300), which provides for assembly at a remote location. The base and framework provide sufficient structural integrity to withstand lifting from the base (106). Moreover, the preassembled unit is able to withstand transport by truck, rail or ship and the stresses and strains faced during transport. The framework achieves substantial weight savings and reduces transportation costs. The base trim (124) may be mounted to the base (106) except for a few elements (124) that are mounted at the installation site to provide access to the base for lifting. This preassembled columbarium may then be transported to the installation site and lifted onto a foundation. The final base trim elements (124) may be installed and the base trim elements adjusted to provide alignment. This method provides for greater flexibility and achieves cost savings over concrete core type columbaria.

Figure 15:
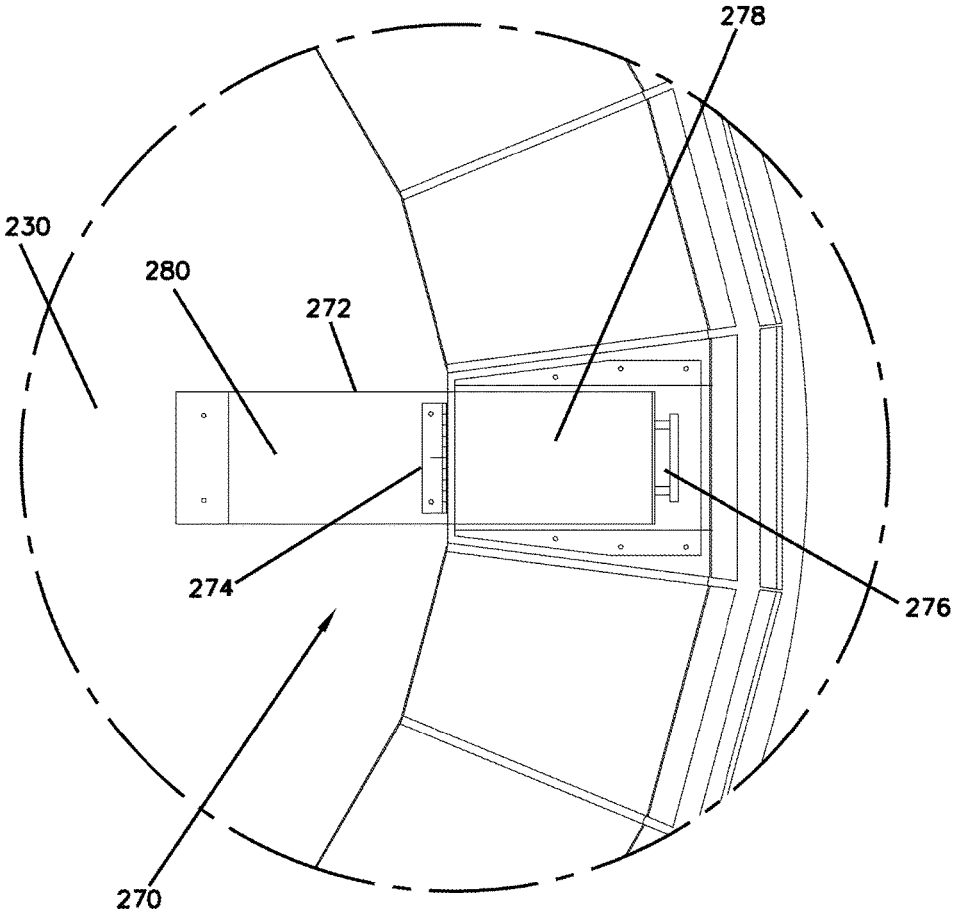
FIG. 15 is a top view of the delivery assembly mounted in a second embodiment of a columbarium according to the principles of the present invention.

Referring now to FIGS. 13-18, the present invention may include a pivoting delivery system for delivering the flexible urns (1000). Referring to FIGS. 13-14, in a first embodiment, a delivery system generally designated (170) is configured for delivering cremated remains into the center ossuary (130) as shown in FIG. 14 or the ossuary (230) as shown in FIG. 15 in a dignified manner. The delivery system (170) includes the pivoting chute or slide (172) and a handle (176) as well as hinge or pivot (174). The hinge (174) allows for the slide to be rotated between a horizontal position and a tilted position as shown in FIG. 13. An inner portion (178) of the rotating slide (172) extends into the access niche (142) while a second portion (180) extends beyond the rear of the access niche (142) and into the inner shared repository of the ossuary (130).

Figure 16:
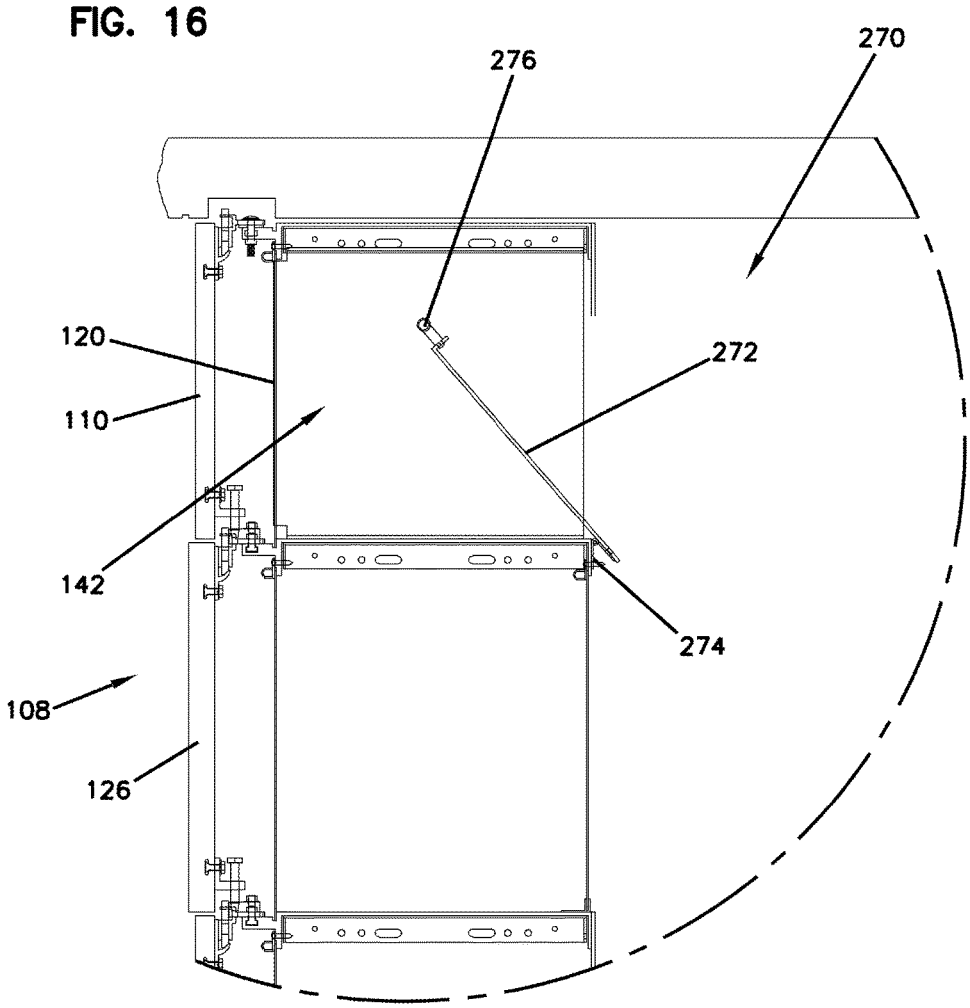
FIG. 16 is a side sectional view of a second embodiment of a delivery assembly for delivering flexible cremains containers.
Figure 17:
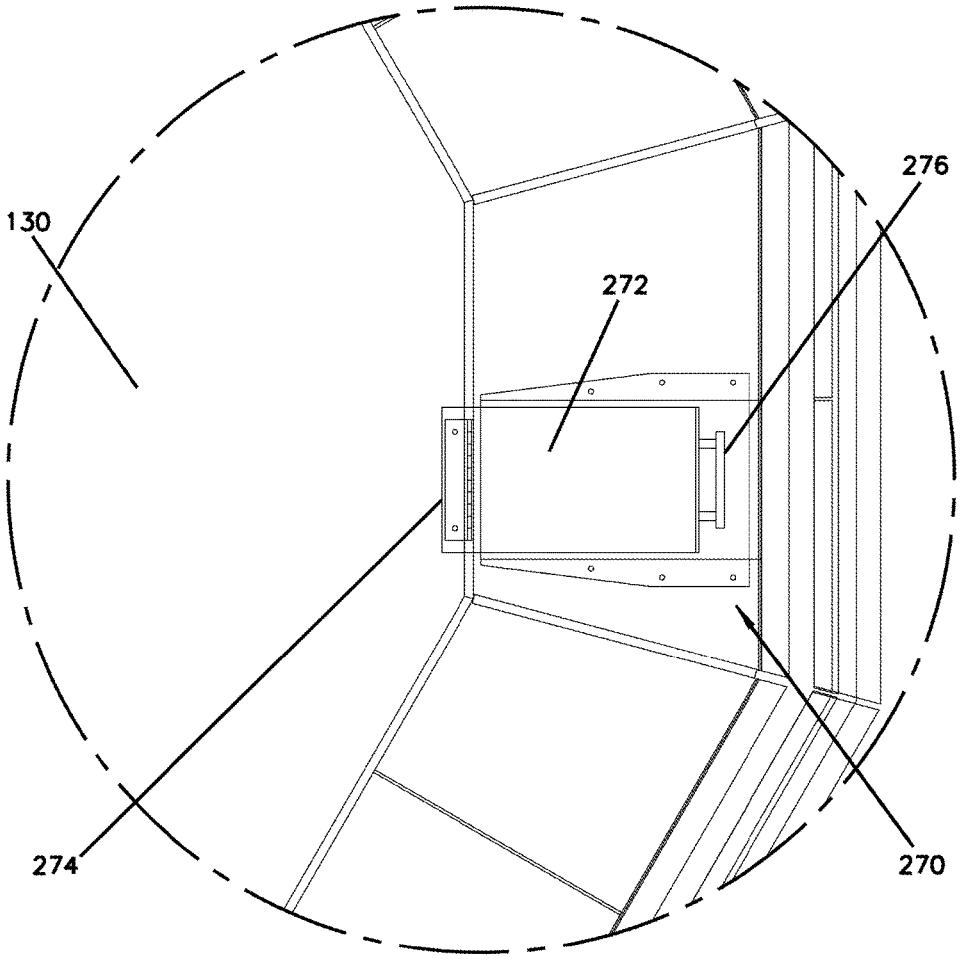
FIG. 17 is a top view of the delivery assembly mounted in the columbarium of FIG. 1.
Figure 18:
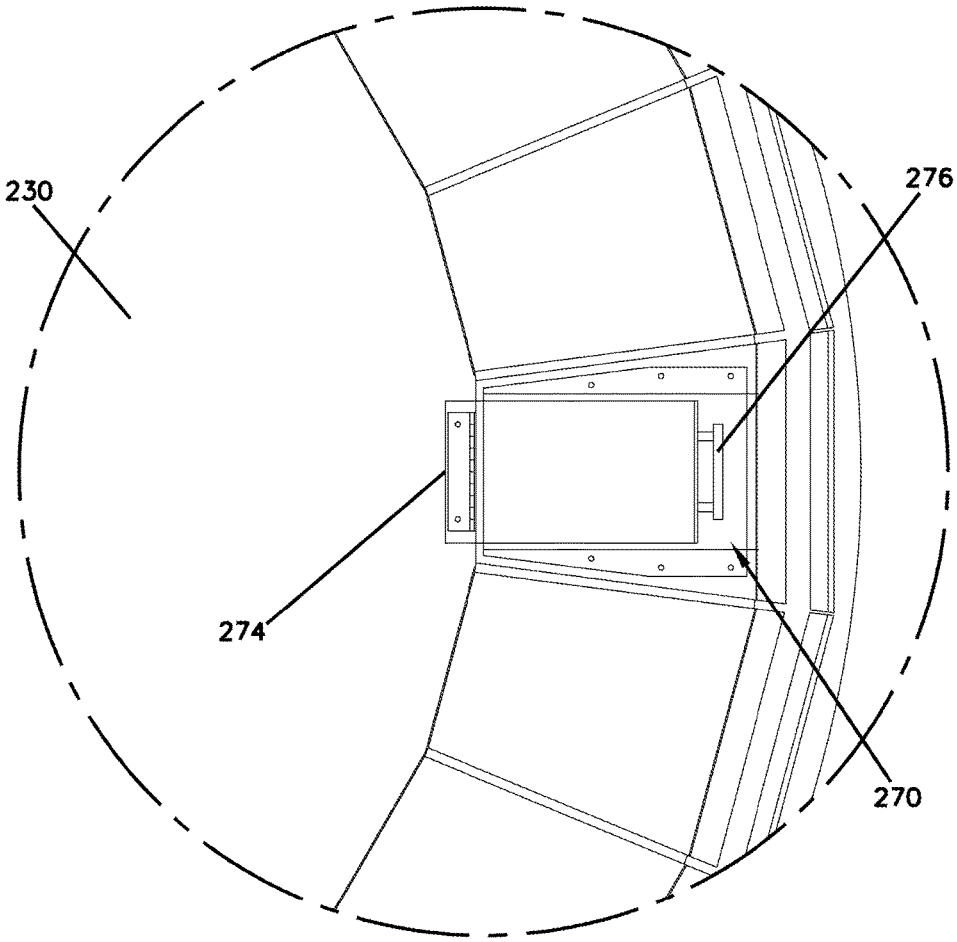
FIG. 18 is a top view of the delivery assembly and the columbarium of FIG. 16.

Referring now to FIGS. 15-18, a second embodiment of a delivery system generally designated (270) is also configured for delivering cremated remains into the center ossuary (130) as shown in FIG. 17 or the ossuary (230) as shown in FIG. 18 in a dignified manner. The delivery system (270) includes a pivoting chute or slide (272) and a handle (276) as well as hinge or pivot (274). An inner portion (278) of the rotating slide (272) extends into the access niche while a second portion (280) extends beyond the rear of the access niche and into the inner shared repository of the ossuary (230). The hinge (274) allows for the slide (272) to be rotated between a horizontal position and a tilted position as shown in FIG. 16. The rotating slide (272) is shorter than the slide (172) of FIGS. 13-15 and does not extend beyond the rear of the access niche (142) and into the shared ossuary (130) or (230).

For a memorial ceremony and interment of cremains, the stone shutter (110) and the inner panel (144) of one of the access niches (142) are removed. A flexible urn may be placed on the upper surface of the slide (172 or 272). When placed in this position, a flexible urn is delivered into the ossuary vault (130 or 230) by simply lifting the handle (176 or 276) and pivoting the slide (172 or (272) upward. The flexible urn then descends along the slide and drops into the open vault of the ossuary (130 or 230). After the cremains are deposited, the inner cover (120) and outer stone shutter (110) are replaced and the columbarium (100) retains its fully closed appearance. Separately, one of the memorial band panels (126) is removed to add an inscription to reflect the interment into the ossuary (130).

Referring now to FIGS. 24-31, there is shown a further embodiment of a twelve sided columbarium, generally designated (400). In the embodiment shown, the columbarium (400) is somewhat cylindrical with a plurality of niches (402) disposed about a periphery of the columbarium. As shown more clearly in FIGS. 25 and 26, each of the niches (402) provides a compartment for storing an urn or a small number of urns in a dignified manner. The columbarium (400) also includes a cover such as a capstone (404), typically made of stone or concrete. The columbarium (400) mounts on a base (406) with base trim elements (418) typically made of bricks or pavers that may be permanently installed on the ground or a foundation. In the embodiment shown, the columbarium (400) includes 96 individual niches (402), although the size of the columbarium and the number of sides can be varied to change the total number of niches (402).

Each of the niches (402) includes a cover, typically a decorative stone shutter, such as a granite or marble shutter (410). With the somewhat cylindrical configuration of the columbarium (400), each niche (402) wider at the outer face and includes panels forming sidewalls (412) that extend radially inward and slightly toward one another. Each niche (402) is enclosed by a top (414) and a bottom (416). For additional security and protection from the elements, the niches (402) may include an inner cover. The shutters (410) are removable and generally held and aligned by hidden mounting hardware (422) that provides alignment and for removal and reattachment of the shutters (410) as may be required when remains are placed in the niche (402). It can be appreciated that all elements of the columbarium (400) are made of weather resistant materials that won't degrade when exposed to the elements and will last for the extended lifetime required of a columbarium (400).

In the embodiment shown, a memorial band (408) is formed near the top of the columbarium (400). The memorial band (408) includes memorial band panels (426). The memorial band panels (426) are also formed of a decorative stone material. The memorial band (408) may extend radially outward beyond the outer faces of the niches (402) to provide a contrasting appearance to the shutters (410). The memorial band panels (426) may also be of a different color and/or material than the other shutters. Moreover, the memorial band panels (426) may cover two or more individual niches (402) and/or have a different height and/or width. The memorial band panels (426) provide an area for identifying individuals' remains held in niches behind the memorial band panels (426) as well as those who may be stored in the inner vault of an inner ossuary (430), as explained hereinafter.

Figure 24:
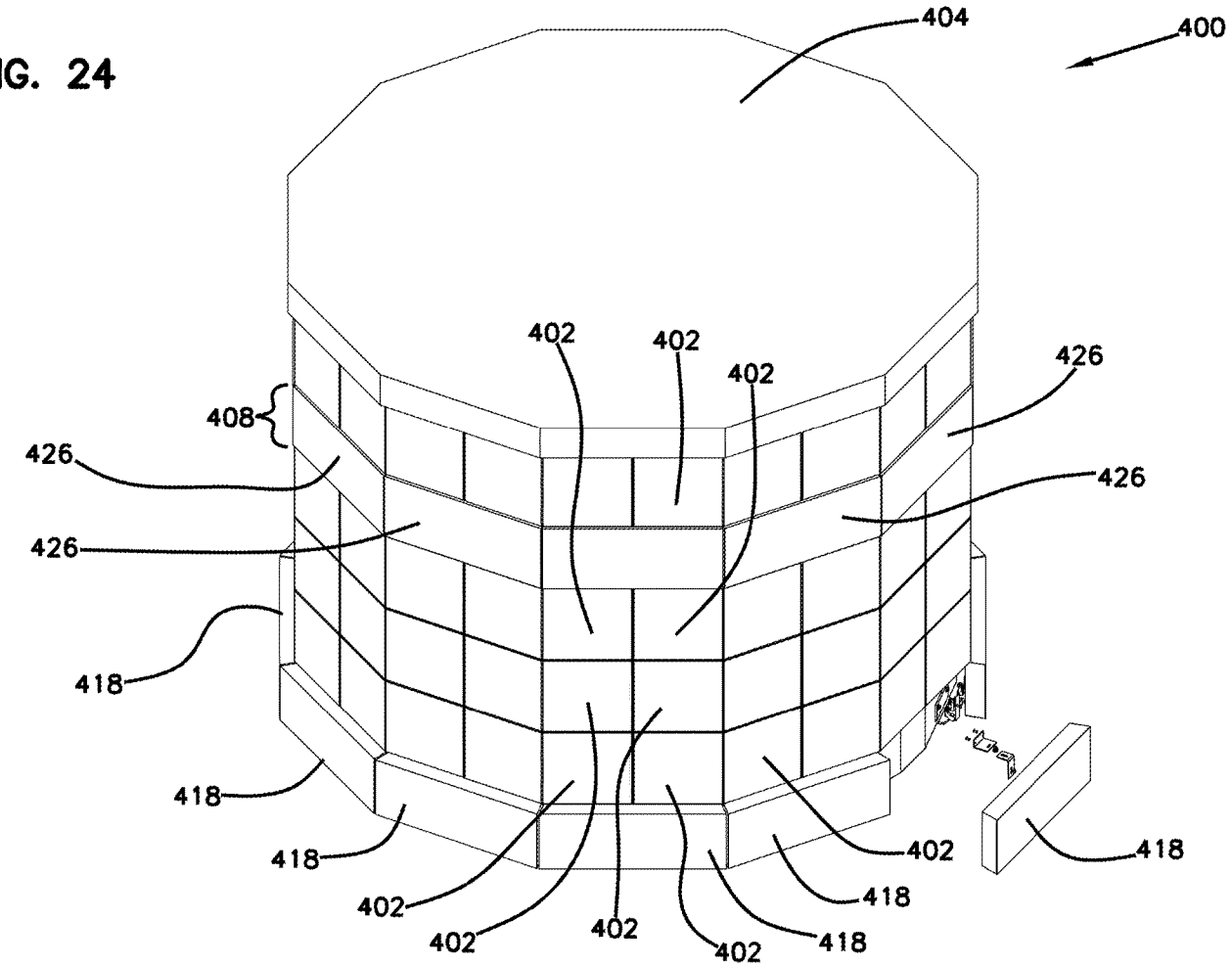
FIG. 24 is a perspective view of a columbarium according to the principles of the present invention with a further embodiment of trim and its mounting.
Figure 25:
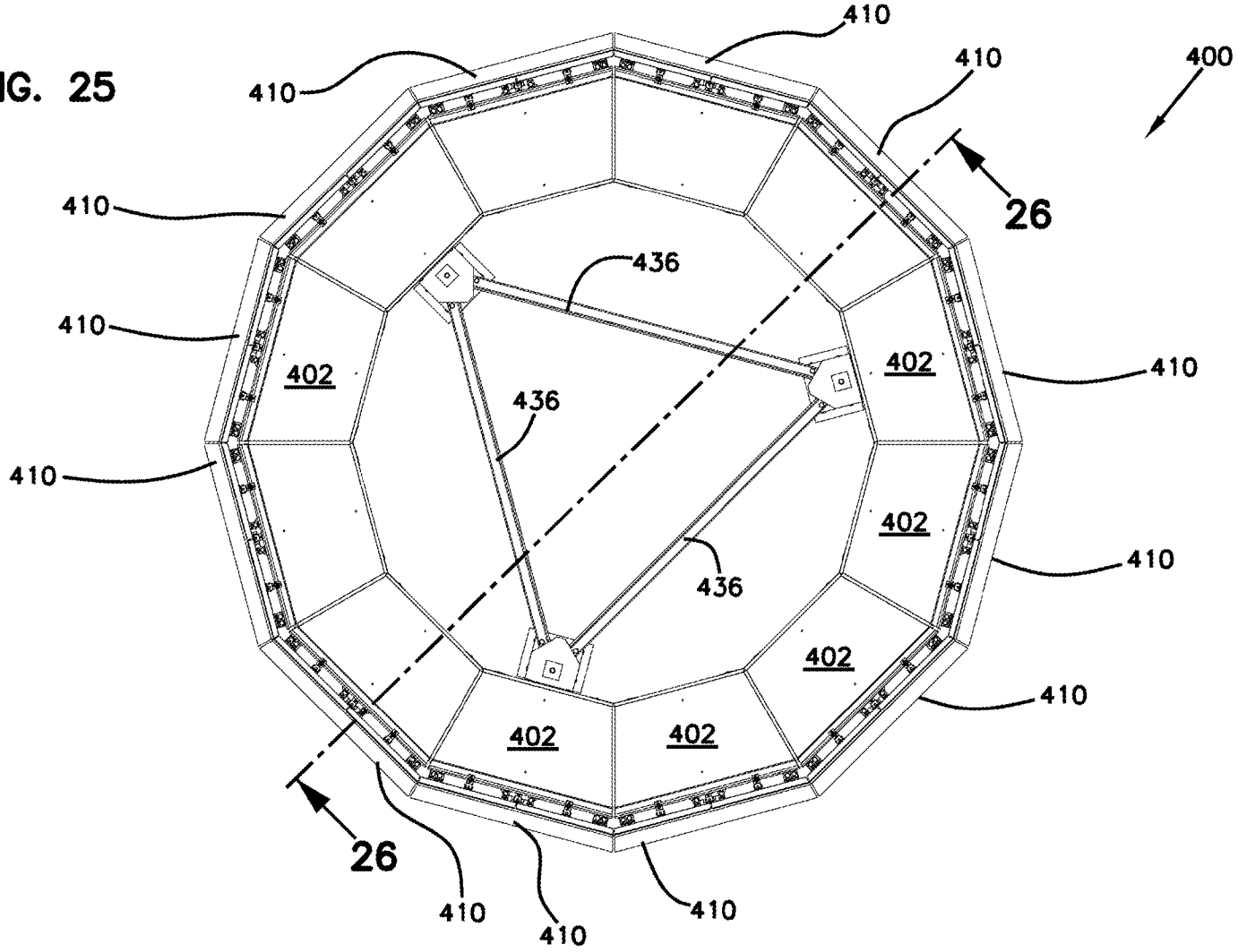
FIG. 25 is a top plan view of the columbarium shown in FIG. 24 with the cap stone removed for clarity.
Figure 26:
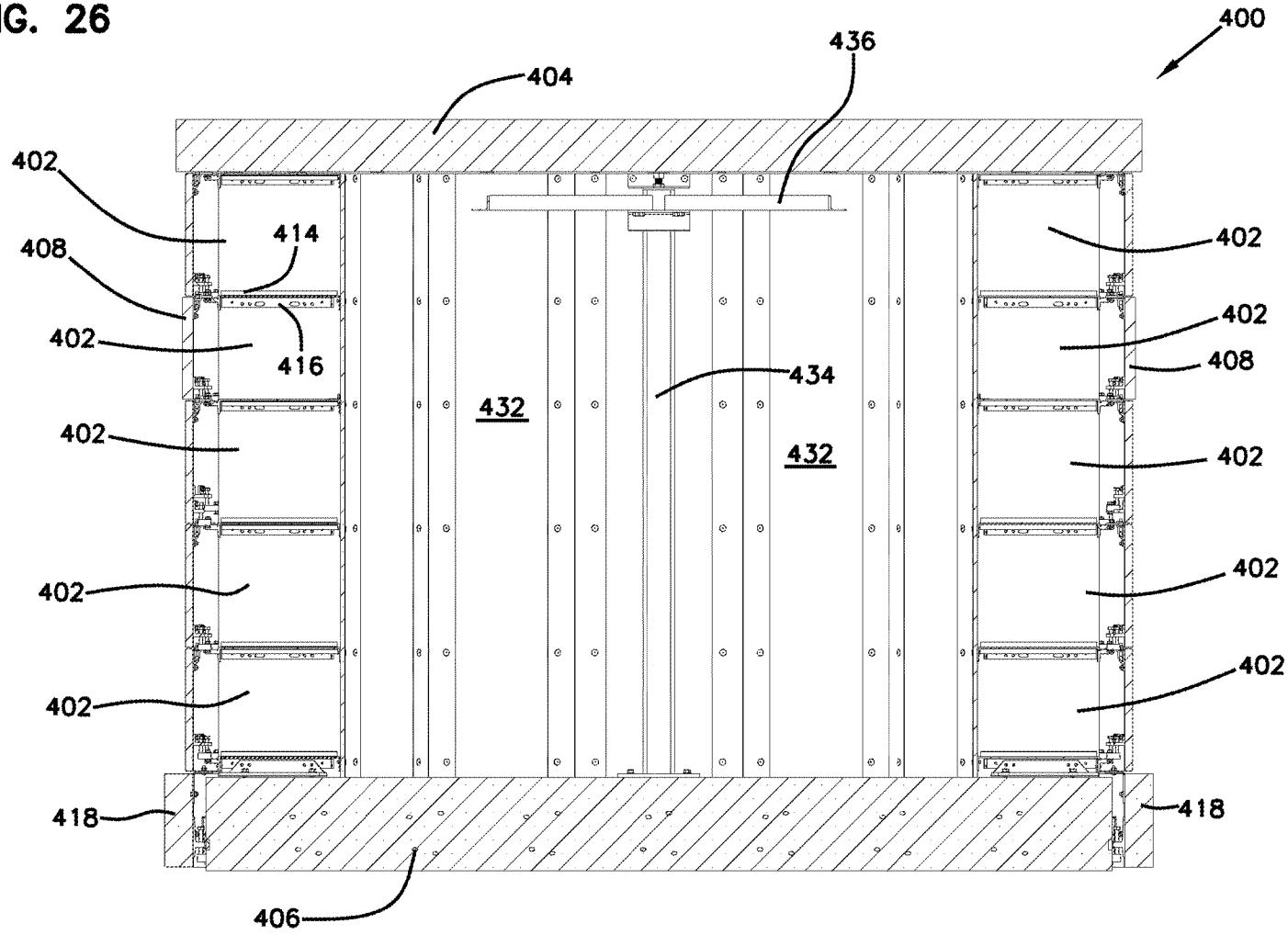
FIG. 26 is a side sectional view of the columbarium shown in FIG. 24.

The columbarium (400) shown in FIGS. 24-26 defines an open inner chamber that forms a vault serving as an ossuary (430). The ossuary (430) includes support posts (434) that mount to the base (406) and also support the capstone (404) as well as providing rigidity. The posts (434) are connected by frame members (436) to form an internal frame. An inner wall (432) of fiberboard or other appropriate materials (402) forms an enclosed space radially inward of the niches.

Figure 27:
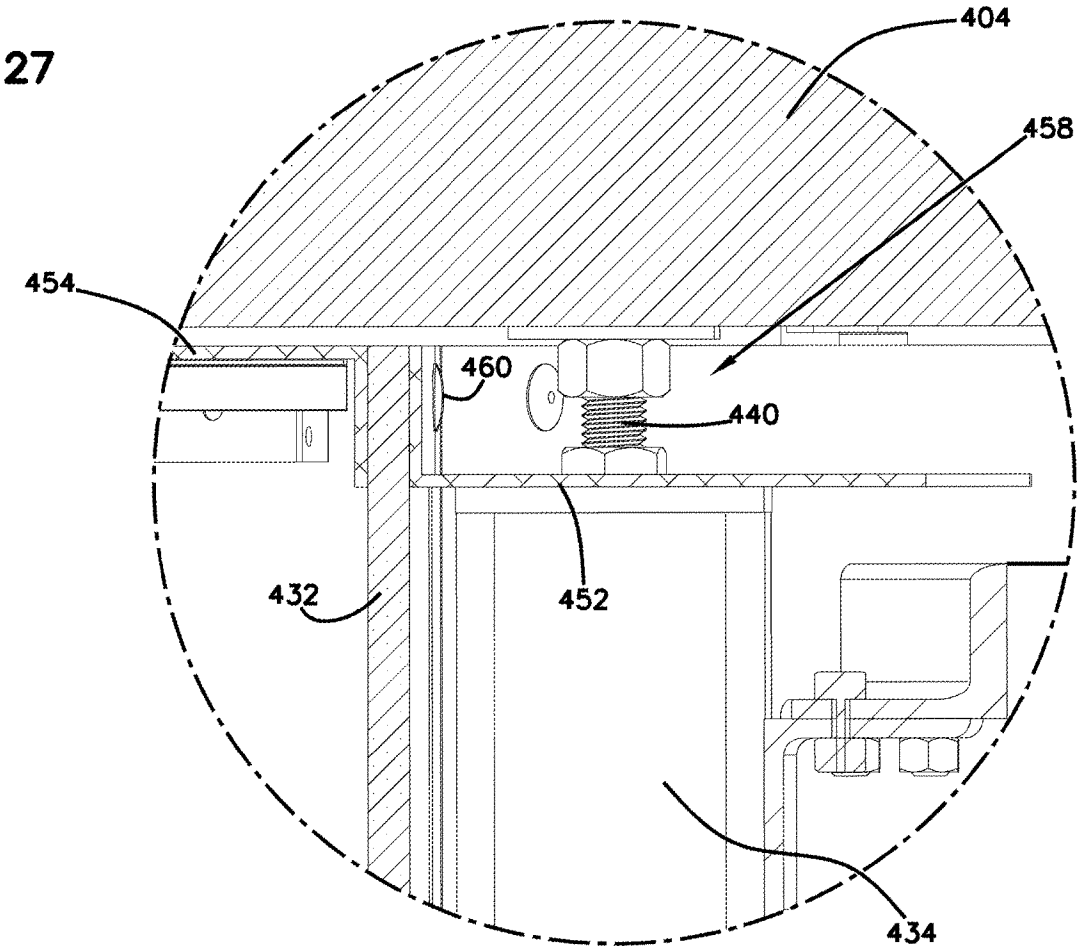
FIG. 27 is sectional detail view of the mounting system for the capstone of the columbarium shown in FIG. 24.

As shown in FIG. 27, the top of the post (434) includes mounting hardware (450) including a torsional bracing bracket (452), an extruded aluminum shelf (454) and a cap plate (456). The rod also includes locking nuts (458) that provide for height adjustment so the capstone (404) is level and properly supported and placed. Blind rivets (460) attach the shelf (454) to the inner wall.

Figure 29:
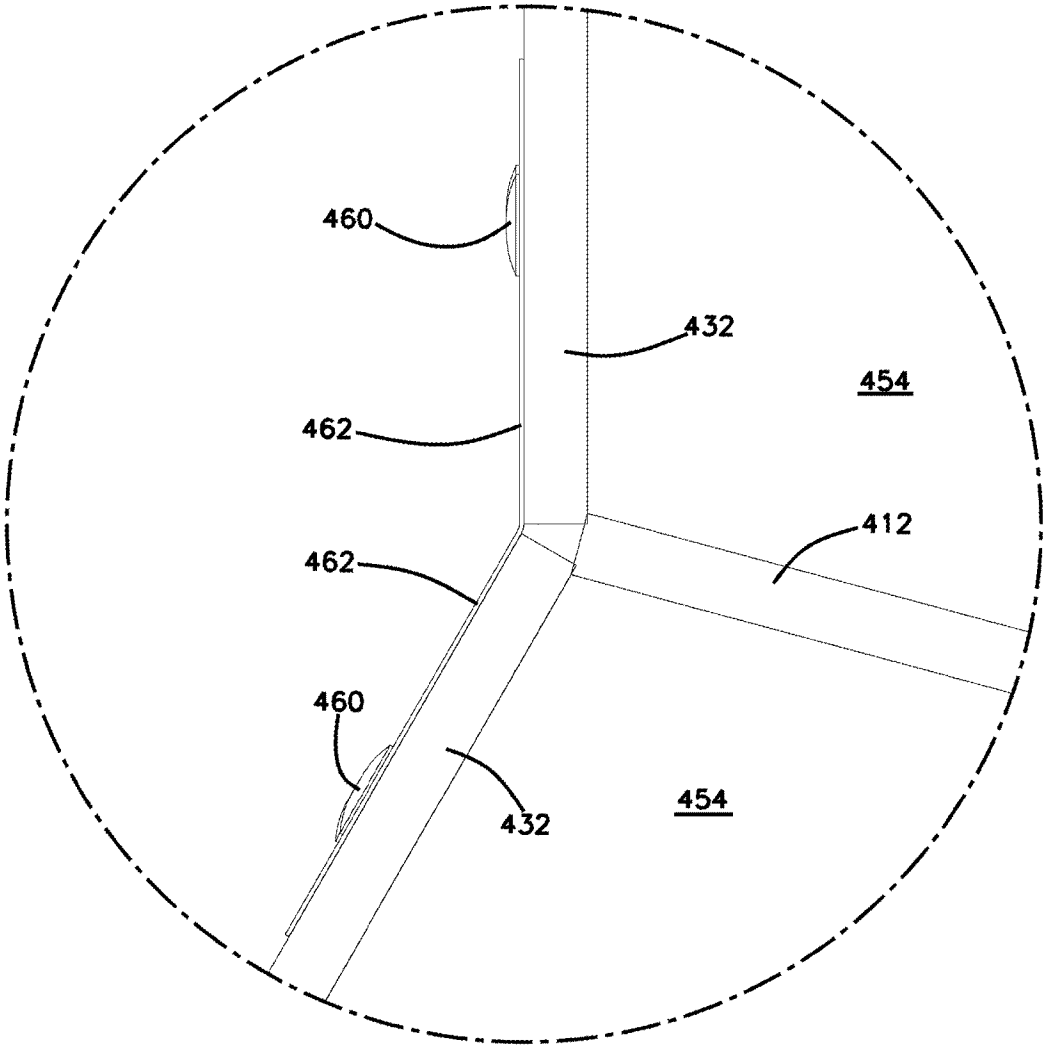
FIG. 29 is a detail view of an intersection of adjacent niches of the columbarium shown in FIG. 24.

FIG. 29 shows the intersection of the inner wall panels (432) and niche sidewalls (412). Rivets (460) connect the inner wall (432) to a joining plate (462) extending between adjacent wall panels (432).

Figure 28:
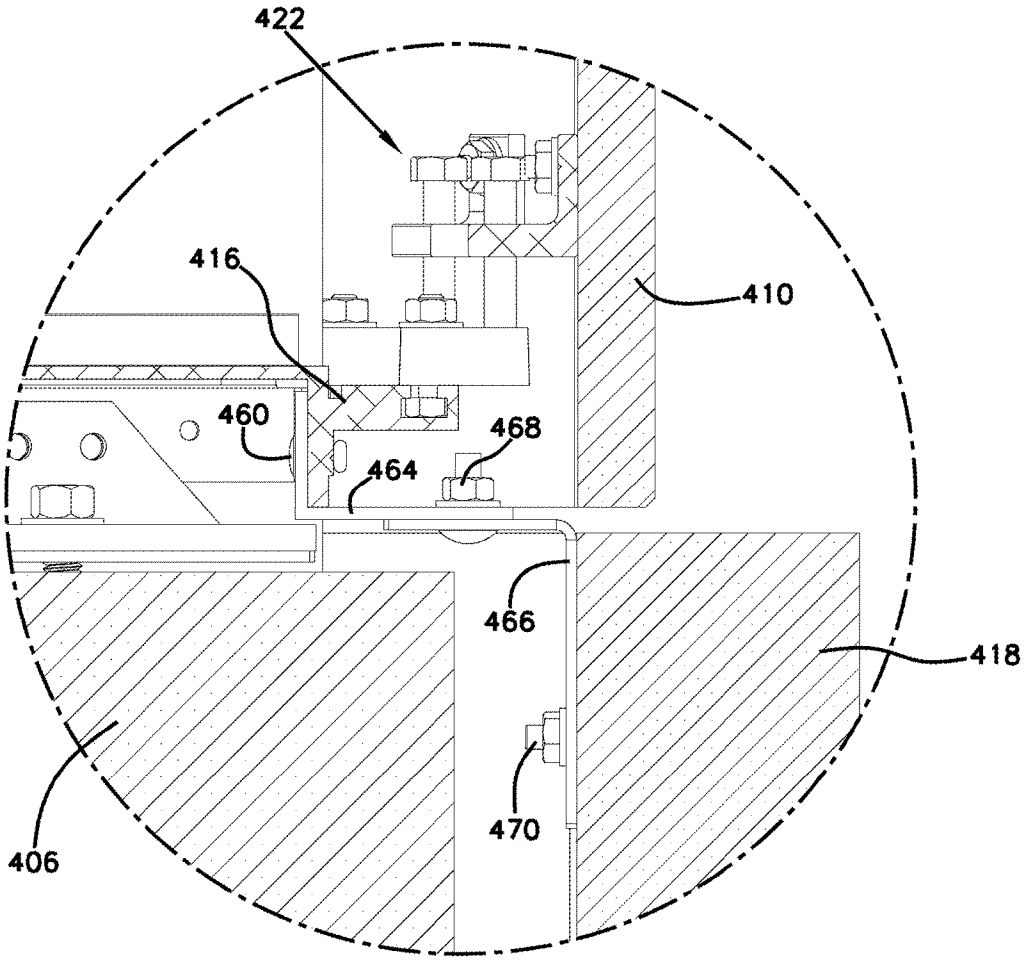
FIG. 28 is sectional detail view of the mounting system for the base trim of the columbarium shown in FIG. 24.
Figure 30:
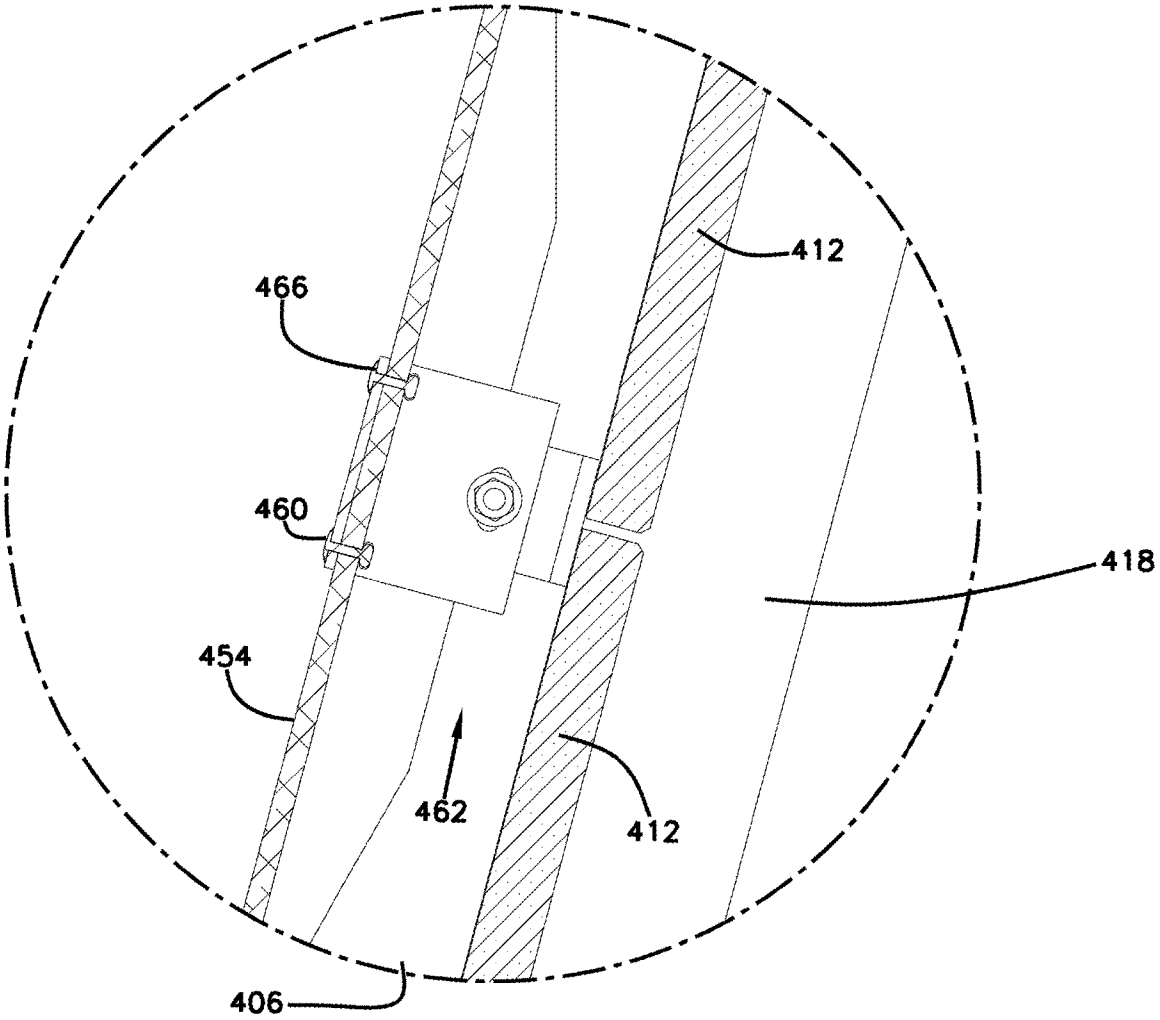
FIG. 30 is a top detail view of mounting of base trim and lower shutters for the columbarium shown in FIG. 24.
Figure 31:
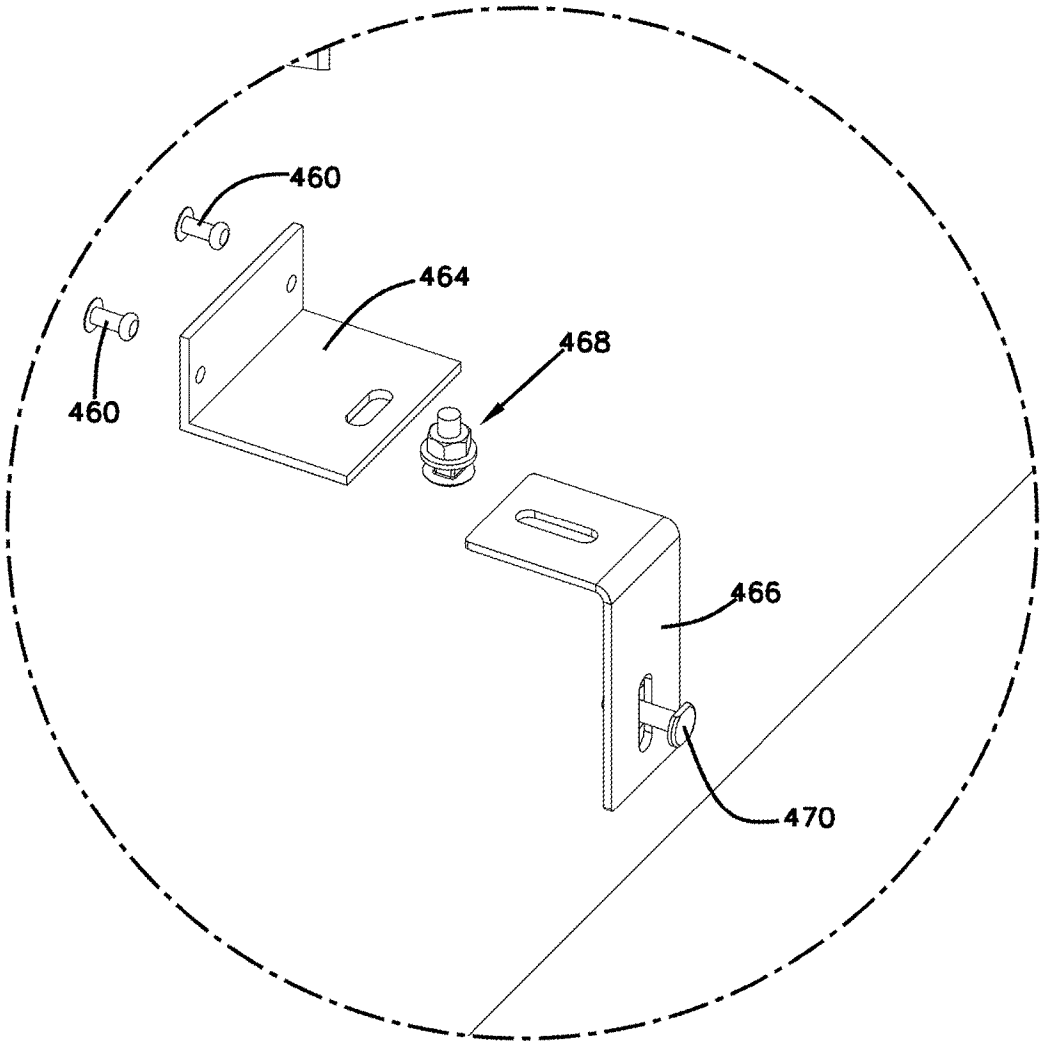
FIG. 31 is an exploded view of base trim mounting hardware for the columbarium shown in FIG. 24.

Referring now to FIGS. 28, 30 and 31, base trim mounting hardware (462) provides for securely mounting base trim elements (418) to the concrete base (406). As shown in FIG. 28 the shutters (410) are attached with hardware (422). The base trim elements (418) mount with mounting brackets (464 and (466) and anchors (470). A carriage bolt and nut assembly (468) joins the brackets (464) and (466). Slots formed in the brackets (464, 466) receive the carriage bolt assembly (468) and extend perpendicular to one another to provide for radial and lateral adjustment. The anchor (470) is a T-31 style anchor that fits into a slot in the base trim element (418).

Referring now to FIGS. 32-38, there is shown a further embodiment of a twelve sided columbarium, generally designated (500). In the embodiment shown, the columbarium (500) is somewhat cylindrical with a plurality of niches (502) disposed about a periphery of the columbarium. As shown more clearly in FIGS. 25 and 26, each of the niches (502) provides a compartment for storing an urn or a small number of urns in a dignified manner. The columbarium (500) also includes a cover such as a capstone (504), typically made of stone or concrete. The columbarium (500) mounts on a base (506) and has base trim elements (518) that may be permanently installed on the ground or a foundation.

Each of the niches (502) includes a cover, typically a decorative stone shutter, such as a granite or marble shutter (510). With the somewhat cylindrical configuration of the columbarium (500), each niche (502) wider at the outer face and includes panels forming sidewalls (512) that extend radially inward and slightly toward one another. Each niche (502) is enclosed by a top (514) and a bottom (516). For additional security and protection from the elements, the niches (502) may include an inner cover. The shutters (510) are removable and generally held and aligned by hidden mounting hardware (522) that provides alignment and for removal and reattachment of the shutters (510) as may be required when remains are placed in the niche (502). It can be appreciated that all elements of the columbarium (500) are made of weather resistant materials that won't degrade when exposed to the elements and will last for the extended lifetime required of a columbarium (500).

Figure 32:
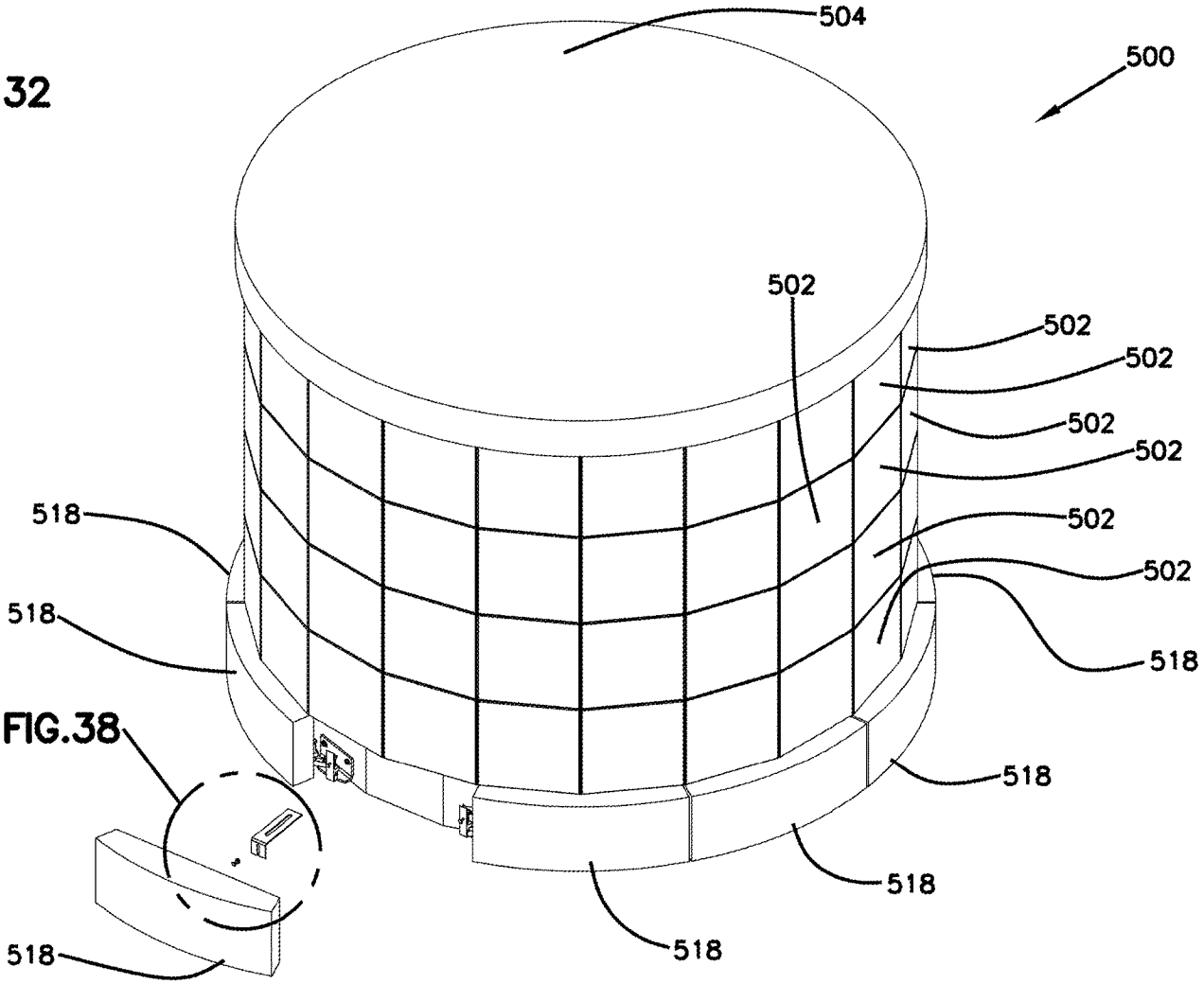
FIG. 32 is a perspective view of another columbarium according to the principles of the present invention with a further embodiment of trim and its mounting.
Figure 33:
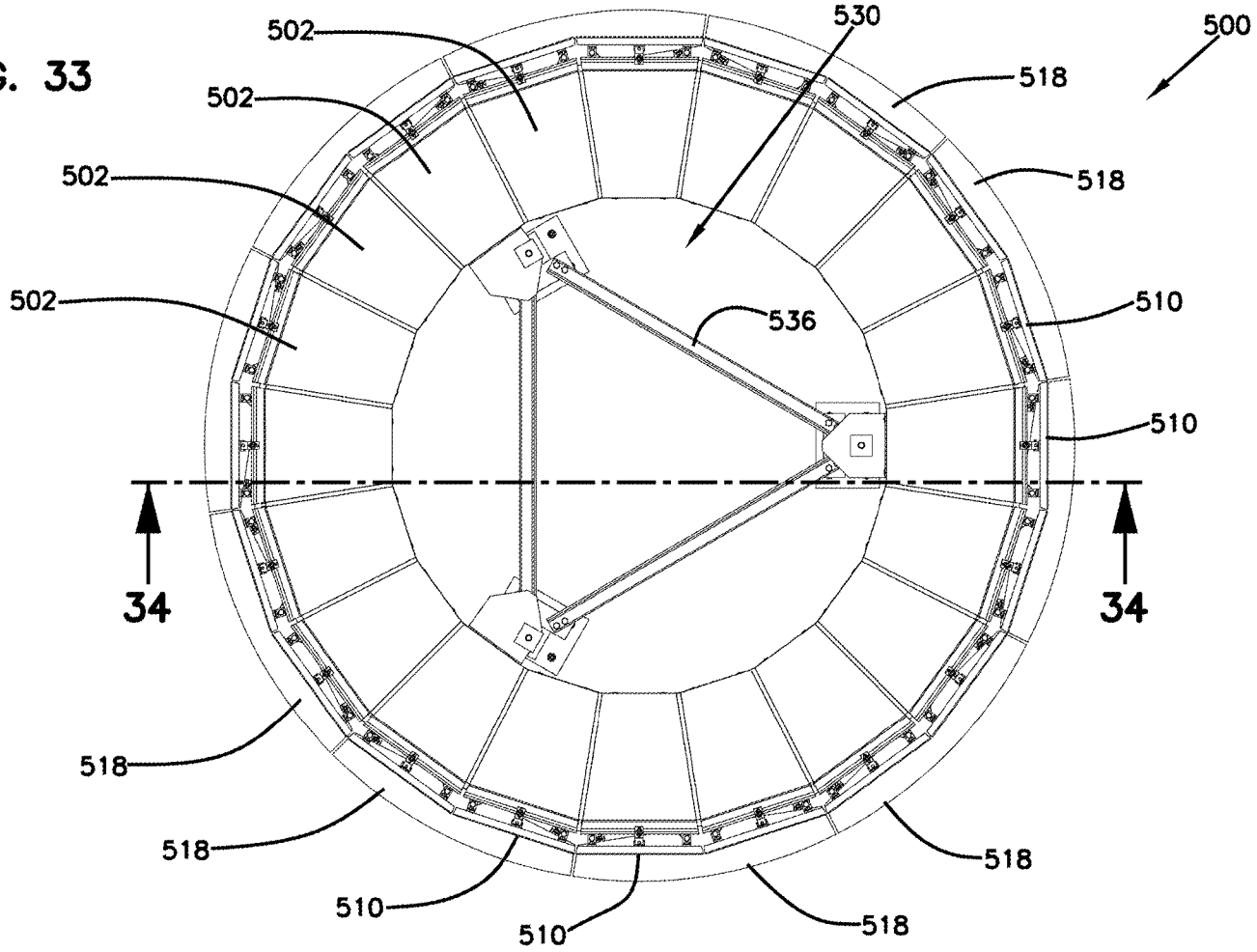
FIG. 33 is a top plan view of the columbarium shown in FIG. 32 with the cap stone removed for clarity.
Figure 34:
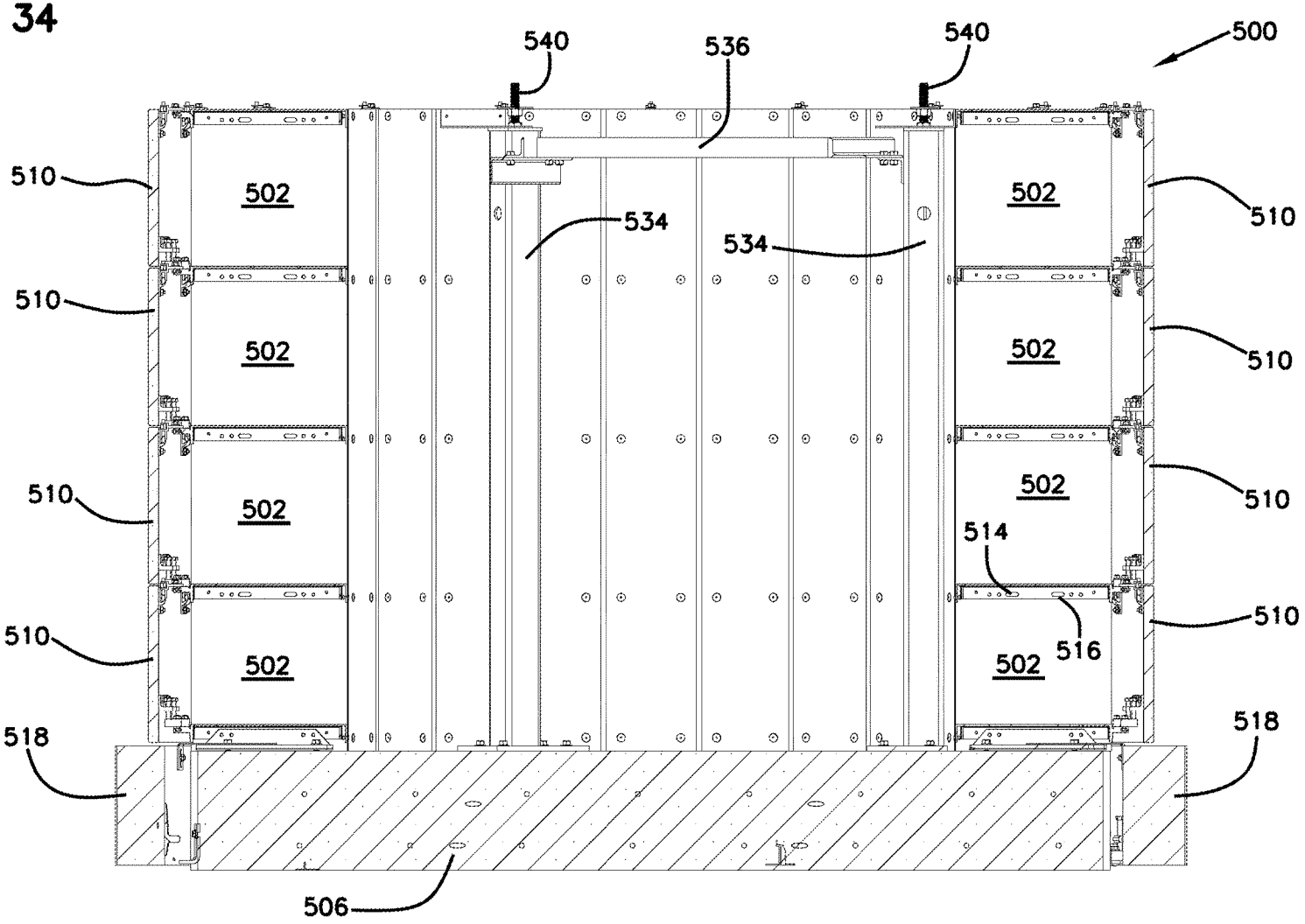
FIG. 34 is a side sectional view of the columbarium shown in FIG. 33.

The columbarium (500) shown in FIGS. 32-34, the columbarium (500) defines an open inner chamber that forms a vault serving as an ossuary (530). The ossuary (530) includes support posts (534) that mount to the base (506) and also support the capstone (504) as well as providing structural rigidity. The posts (534) are connected by frame members (536) to form a triangular internal frame.

Figure 35:
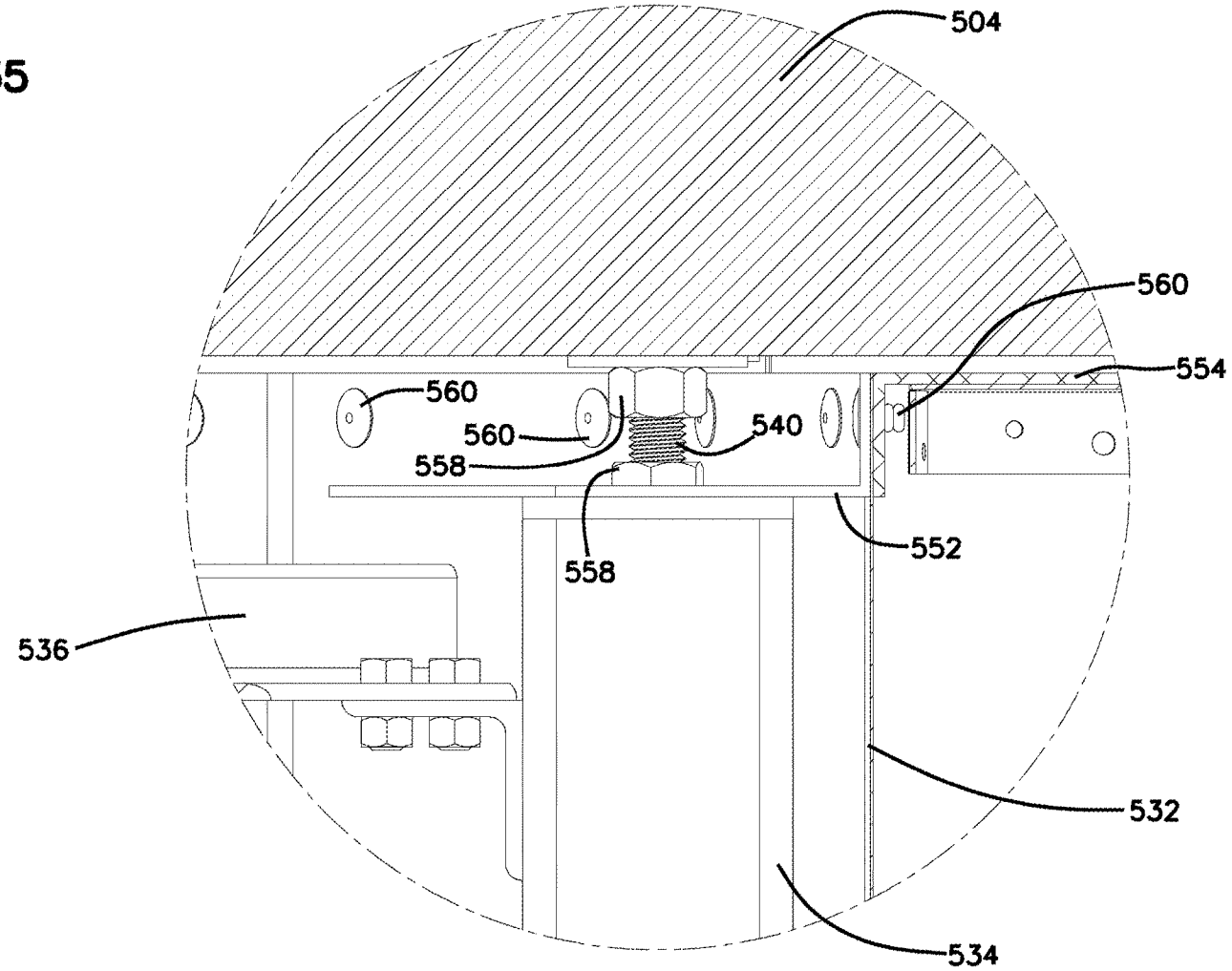
FIG. 35 is sectional detail view of the mounting system for the capstone of the columbarium shown in FIG. 32.

As shown in FIG. 35, the top of the post (534) includes mounting hardware (550) including a torsional bracing bracket (552), an extruded aluminum shelf (554) and a cap plate (556). Locking nut assemblies (558) provide for height adjustment so the capstone (504) is level and properly supported and placed. Blind rivets (560) attach the shelf (554) to the inner wall (532). The bracket (552) attaches to the top of each inner structural post assembly (534) and the inner wall (532) and shelf (514) to increase torsional rigidity of the inner framework. The locking nut (558) attaches the torsional bracket (552) to the top of the post assembly (534) and also locks a stud (540) extending upward to the post. For nearly round columbaria, such as the 20 sided embodiment (500), the inner wall (532) is made of stainless steel sheets trimmed to the proper height and each sheet overlaps adjacent sheets by at least 6 inches. The stainless steel sheets increase rigidity of the columbarium (500).

Figure 37:
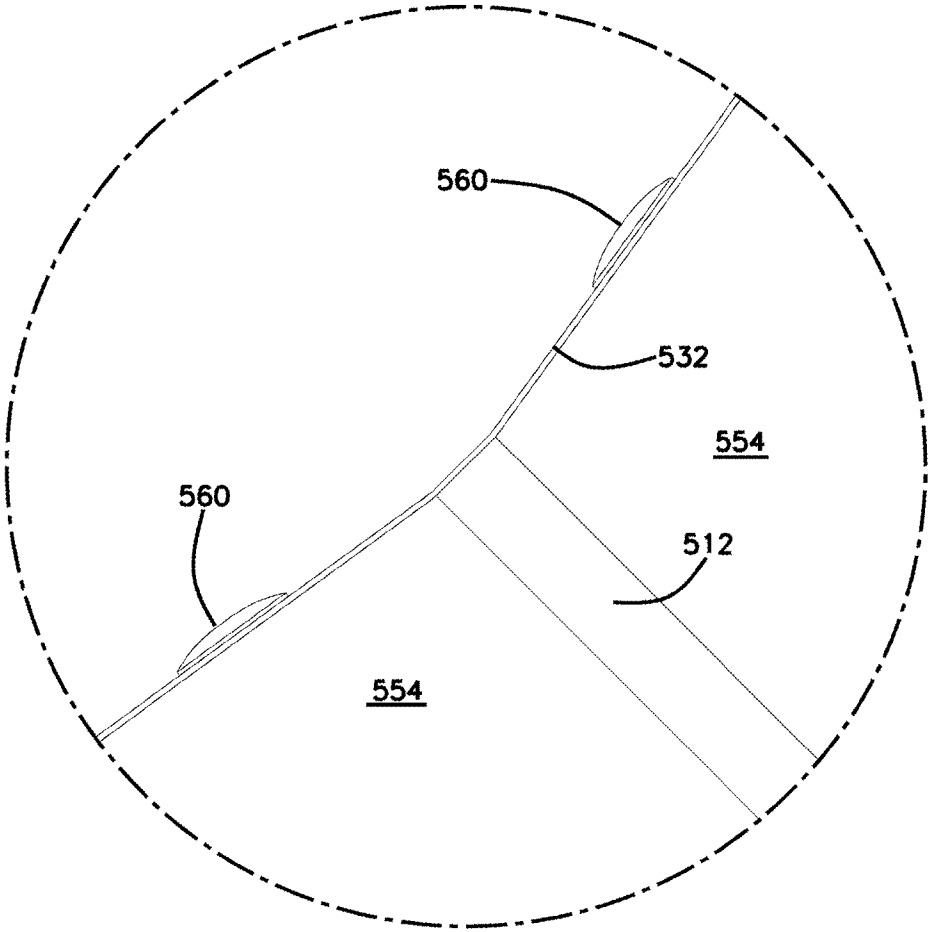
FIG. 37 is a detail view of an intersection of adjacent niches of the columbarium shown in FIG. 32.

FIG. 37 shows the intersection of the inner wall panels (532) and niche sidewalls (512). Rivets (560) connect the inner wall (532) to a joining plate (562) extending between adjacent wall panels (532).

Figure 36:
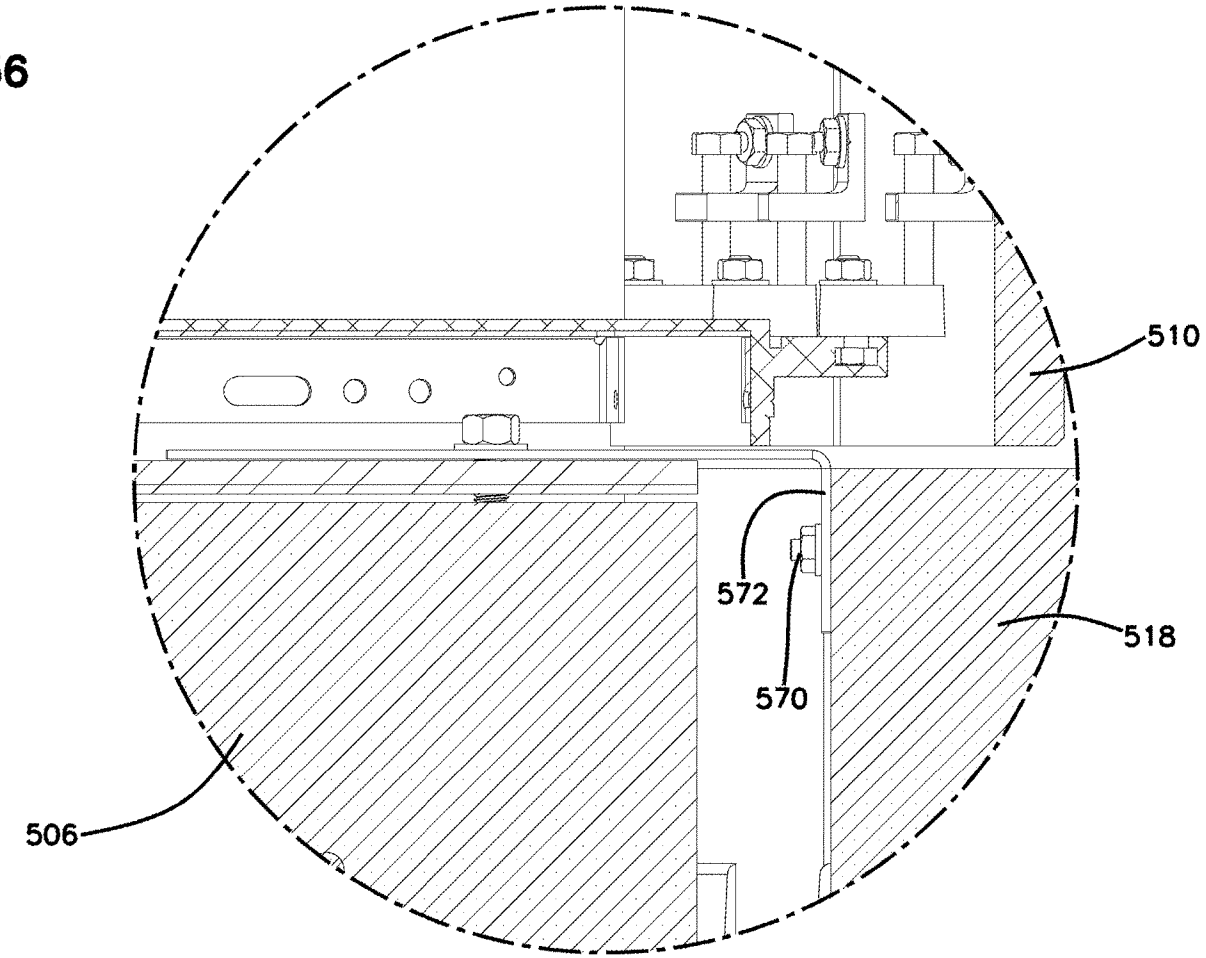
FIG. 36 is sectional detail view of the mounting system for the base trim of the columbarium shown in FIG. 32.
Figure 38:
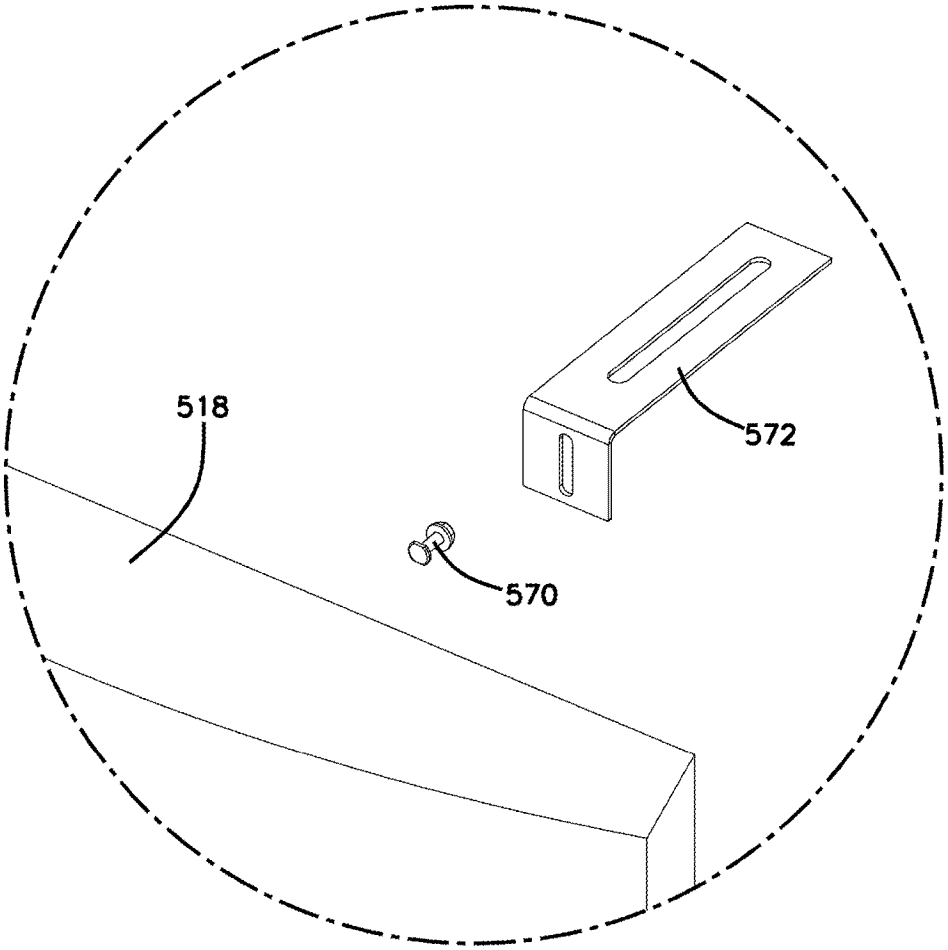
FIG. 38 is an exploded view of base trim mounting hardware for the columbarium shown in FIG. 32.

Referring now to FIG. 36, base trim mounting hardware (562) provides for securely mounting base trim elements (518) to the concrete base (506). As shown in FIG. 28 the shutters (510) are attached with hardware (522). Each of the base trim elements (518) mounts with an associated mounting bracket (572) and anchor (570). A carriage bolt and nut assembly (568) mounts the bracket (572) to the base (506). The mounting bracket (572) has an elongated slot as shown in FIG. 38 to provide for proper positioning and adjustment inward or outward. The anchor (570) is a T-31 style anchor that fits into a pre-aligned slot in the base trim element (518). If the installation leads to misalignment, a hole may need to be drilled in the base trim (518). This system is typically only used with columbaria having a nearly rounded shape such as 16, 20 or 24 sided columbaria.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A columbarium comprising:

a concrete base;

an inner core defining a central open volume and comprising:

an inner wall extending around a periphery of the inner core, the inner wall comprising an element having a substantially circular horizontal cross-section;

a plurality of spaced apart support posts;

a plurality of niches mounted around a periphery of the inner core; and a capstone above and covering the plurality of niches and open volume and supported by the support posts.

2. The columbarium according to claim 1, wherein the concrete base comprises reinforced concrete.

3. The columbarium according to claim 1, the inner wall comprising a stainless steel element having a substantially circular horizontal cross-section.

4. The columbarium according to claim 1, wherein the posts comprise steel tubes.

5. The columbarium according to claim 1, further comprising an ossuary.

6. The columbarium according to claim 1, further comprising a vault below the columbarium.

7. The columbarium according to claim 6, further comprising a chute accessible from the columbarium and leading to the vault.

8. The columbarium according to claim 1, further comprising a vault below the columbarium.

9. The columbarium according to claim 1, further comprising a chute accessible from at least one of the plurality of niches and leading to the vault.

10. The columbarium according to claim 1, further comprising a delivery system for conveying remains from an access niche to the central open volume.

11. The columbarium according to claim 10, wherein the delivery system comprises a slide extending from the access niche to the central open volume.

12. The columbarium according to claim 10, wherein the delivery system comprises a rotatable slide extending from the access niche to the central open volume.

13. A columbarium comprising:

a concrete base;

an inner core defining a central open volume and comprising:

an inner wall extending around a periphery of the inner core;

a plurality of spaced apart support posts;

a plurality of niches mounted around a periphery of the inner core; and a capstone above and covering the plurality of niches and open volume and supported by the support posts;

base trim mounting assemblies mounting base trim elements to the base, each base trim mounting assembly including vertical adjustment elements, lateral adjustment elements and radial adjustment elements.

14. The columbarium according to claim 1, the inner wall comprising a non-degradable material.

15. The columbarium according to claim 1, the inner wall comprising a non-degradable alloy.

* * * * *